US011420250B2

(12) United States Patent
Takama et al.

(10) Patent No.: US 11,420,250 B2
(45) Date of Patent: Aug. 23, 2022

(54) MOLD MATERIAL, METHOD OF PRODUCING THE SAME, AND METHOD OF PRODUCING CASTING MOLD

(71) Applicant: ASAHI YUKIZAI CORPORATION, Nobeoka (JP)

(72) Inventors: Tomohiro Takama, Niwa-Gun (JP); Tetsuya Ura, Niwa-Gun (JP)

(73) Assignee: Asahi Yukizai Corporation, Nobeoka (JP)

( * ) Notice: Subject to any disclaimer, the term of this patent is extended or adjusted under 35 U.S.C. 154(b) by 29 days.

(21) Appl. No.: 16/893,741

(22) Filed: Jun. 5, 2020

(65) Prior Publication Data

US 2020/0306821 A1 Oct. 1, 2020

Related U.S. Application Data

(63) Continuation of application No. PCT/JP2018/048489, filed on Dec. 28, 2018.

(30) Foreign Application Priority Data

Dec. 28, 2017 (JP) ..... JP2017-253876

(51) Int. Cl.

| | |
|---|---|
| ***B22C 1/02*** | (2006.01) |
| ***B22C 1/10*** | (2006.01) |
| ***B22C 1/18*** | (2006.01) |
| ***B22C 9/02*** | (2006.01) |
| ***B22C 9/12*** | (2006.01) |

(52) U.S. Cl.

CPC ..... *B22C 1/10* (2013.01); *B22C 1/18* (2013.01); *B22C 9/02* (2013.01)

(58) Field of Classification Search

CPC .... B22C 1/02; B22C 1/10; B22C 1/18; B22C 9/02; B22C 9/12

USPC ..... 164/6, 21, 525, 526, 527, 528; 106/38.3, 106/38.9

See application file for complete search history.

(56) References Cited

U.S. PATENT DOCUMENTS

| | | | |
|---|---|---|---|
| 2008/0099180 | A1 | 5/2008 | Weicker et al. |
| 2017/0050236 | A1 | 2/2017 | Tanaka |

FOREIGN PATENT DOCUMENTS

| | | | |
|---|---|---|---|
| CN | 103611877 | A | 3/2014 |
| CN | 104057017 | A | 9/2014 |
| JP | H09-070641 | A1 | 3/1997 |

(Continued)

OTHER PUBLICATIONS

International Search Report and Written Opinion (Application No. PCT/JP2018/048489) dated Apr. 9, 2019.

(Continued)

*Primary Examiner* — Kevin P Kerns

(74) *Attorney, Agent, or Firm* — Burr & Brown, PLLC

(57) ABSTRACT

Provided are: a mold material having improved fluidity and being capable of improving a filling rate of a forming mold during formation of a casting mold; and a mold material that gives cast products a favorable casting surface, effectively improves sand adhesion on cast products, and advantageously provides a casting mold having excellent strength. The mold material is formed as a coated sand in a wet state with spherical particles of silicone resin having binder repellency existing on its surface, by at least mixing a water-soluble inorganic binder in the liquid state having a viscosity of not more than 1000 cP, and the spherical particles of silicone resin, with a refractory aggregate.

13 Claims, 2 Drawing Sheets

(56) References Cited

FOREIGN PATENT DOCUMENTS

| | | | |
|---|---|---|---|
| JP | 2008-511447 | A1 | 4/2008 |
| JP | 2012-076115 | A1 | 4/2012 |
| JP | 4953511 | B2 | 6/2012 |
| JP | 2018-203597 | A1 | 12/2018 |
| WO | 2015/194550 | A1 | 12/2015 |
| WO | 2018/147419 | A1 | 8/2018 |

OTHER PUBLICATIONS

Chinese Office Action (Application No. 201880084169.6) dated Mar. 1, 2021 (with English translation).

MOLD MATERIAL, METHOD OF PRODUCING THE SAME, AND METHOD OF PRODUCING CASTING MOLD

This application is a continuation of the International Application No. PCT/JP2018/048489 filed on Dec. 28, 2018, which claims the benefit under 35 U.S.C. § 119(a)-(d) of Japanese Application No. 2017-253876 filed on Dec. 28, 2017, the entireties of which are incorporated herein by reference.

BACKGROUND OF THE INVENTION

Field of the Invention

The present invention relates to a mold material and a method of producing the same, and a method of manufacturing a casting mold. More particularly, the invention relates to a mold material capable of advantageously providing an intended casting mold and a method of producing such a mold material. The invention further relates to a method of manufacturing an excellent casting mold by using the mold material.

Description of Related Art

As a casting mold used for casting molten metal, one which is obtained by forming a coated sand (mold material) into a desired shape has been employed. The coated sand used here is obtained by coating a molding sand consisting of a refractory aggregate, with a suitable binder. As examples of the binder, inorganic binders such as a water glass, and organic binders using a resin such as a phenolic resin, a furan resin and a urethane resin are known, and methods of forming self-curing molds by using these binders have been put to practical use.

Meanwhile, a coated sand obtained by using the above-mentioned binder tends to suffer from deterioration of fluidity due to the presence of the binder. Thus, the coated sand has inherent problems that filling deficiency may be caused in a forming cavity of a metal die (forming mold) for forming a casting mold, and that the casting mold obtained therefrom does not have a sufficient degree of strength, for example. In particular, in a coated sand obtained by using an organic binder among the binders, volatile components remaining in the organic binder are emitted to the outside to generate an odor, at the time of producing the coated sand and manufacturing a casting mold by using the coated sand. There are also problems that organic components in the organic binder are decomposed to generate gas at the time of casting molten metal, resulting in gas deficiency in the obtained casting mold and deterioration of the working environment.

For this reason, recently, inorganic binders which do not contain any organic component have drawn attention. However, a coated sand obtained by using the inorganic binder has an inherent problem that a casting mold formed of the coated sand does not have a sufficient degree of collapsibility after a casting process. Besides, the strength of the formed casting mold is undesirably deteriorated by moisture-absorption.

In view of the above, JP2008-511447A suggests a mold material as a molding mixture for manufacturing a metal processing mold, which mold material is formed by using at least one refractory mold raw material and at least one binder based on a water glass. To the binder, a particulate metal oxide, which is selected from the group consisting of silicon dioxide, aluminum oxide, titanium oxide and zinc oxide, is added at a predetermined ratio. The addition of the particulate metal oxide is considered to permit an advantage of improvements of initial mold strength (mold strength immediately after the production), mold strength after storage for a long period of time, and moisture resistance of the mold, for example.

However, the molding mixture (mold material) containing the particulate metal oxide along with the water glass as the binder has a problem that the water glass adheres also to the particulate metal oxide by mixing of the components, whereby the molding mixture adheres to a metal die at an increased number of points. Thus, a casting mold to be manufactured by the metal die suffers from poor mold-releasability, so that breakage of the casting mold may be caused at the time of its removal from the metal die. Furthermore, in the case where the binder (water glass) is prepared to have a low viscosity for thereby improving the mold strength, the binder having a low viscosity is allowed to move within the metal die (forming cavity) due to an influence of air pressure at the time of casting, even after the molding mixture (mold material) is blown into the metal die. As a result, the binder is unevenly distributed on an inner surface of the forming cavity, so that the mold-releasability tends to be further deteriorated. Besides, where the molding mixture (mold material) has a high degree of fillability, particles of the mold raw material (aggregate) mutually adhere at an increased number of points, resulting in a problem of poor collapsibility of the obtained casting mold.

JP4953511B2 discloses a molding sand composition (mold material) comprising a refractory particulate aggregate and non-hollow spherical particles having an average particle diameter of a predetermined ratio in terms of an average particle diameter of the refractory particulate aggregate, the non-hollow spherical particles being selected from the group consisting of silica, silicone resins, alumina glass, mullite, polyethylene, polypropylene, polystyrene, (meth) acrylic acid resins and fluorine resins. It is said that the molding sand composition has improved fluidity, and is suitably used for manufacturing a complicated mold and a high-strength mold. However, such improved fluidity of the molding sand composition is not satisfactory for molding a casting mold having a shape getting more and more complicated in recent years, and a further improvement of fluidity is desired. In addition, it is also required to improve the casting surface of a cast product obtained in the casting process employing a casting mold formed of the molding sand composition, and also to prevent sand adhesion to the cast product.

SUMMARY OF THE INVENTION

The present invention was completed in view of the background art described above. Therefore, a problem to be solved by the present invention is to provide a mold material with further improved fluidity, which permits an improvement of a rate of filling to a forming mold at the time of mold formation. It is another problem to be solved by the invention to provide a mold material for advantageously manufacturing a casting mold having excellent strength with good mold-releasability and collapsibility, which casting mold yields a cast product with a good casting surface and effectively prevents sand adhesion to the cast product. In addition, the present invention also intends to provide a method of advantageously producing the mold material having the above-mentioned excellent properties, and a method of advantageously manufacturing the casting mold having the above-mentioned excellent properties by using the mold material.

In order to solve the above-mentioned problems, the present invention can be preferably embodied in various modes which will be described below. It is to be understood that the modes and technical features of the present invention are not limited to those described below, and can be recognized based on the inventive concept disclosed in the specification and the attached drawings taken as a whole.

(1) A mold material, wherein a refractory aggregate, a water-soluble inorganic binder in the liquid state having a viscosity of not more than 1000 cP, and spherical particles of silicone resin having binder-repellency are at least mixed with each other, whereby the mold material is formed as a coated sand in a wet state which has the spherical particles on its surface.

(2) The mold material according to the above-mentioned mode (1), wherein the spherical particles have a weight reduction ratio within a range of 5-50%, when the spherical particles are subjected to heating in a thermogravimetric/differential thermal analyzer from room temperature to 700° C. in an air atmosphere.

(3) The mold material according to the above-mentioned mode (1) or (2), wherein an average particle diameter of the spherical particles is within a range of 0.01 μm-50 μm.

(4) The mold material according to any one of the above-mentioned modes (1) to (3), wherein a content of the spherical particles is within a range of 0.1-500 parts by mass per 100 parts by mass of a solid content of the water-soluble inorganic binder in the mold material.

(5) The mold material according to any one of the above-mentioned modes (1) to (4), wherein the spherical particles are resin particles whose main component is organopolysiloxane.

(6) The mold material according to the above-mentioned mode (5), wherein the organopolysiloxane is silsesquioxane.

(7) The mold material according to the above-mentioned mode (6), wherein the silsesquioxane is polymethylsilsesquioxane.

(8) The mold material according to any one of the above-mentioned modes (1) to (7), wherein the spherical particles have binder-repellency characterized in that, when the water-soluble inorganic binder in the liquid state is dripped on a horizontal plane formed of the spherical particles, a contact angle between the water-soluble inorganic binder and the horizontal plane is not less than 90°.

(9) The mold material according to any one of the above-mentioned modes (1) to (8), further comprising at least one nitrate selected from the group consisting of alkali metal salts and alkaline earth metal salts of nitric acid.

(10) The mold material according to any one of the above-mentioned modes (1) to (9), wherein the water-soluble inorganic binder contains a water glass as its main component.

(11) A method of producing a mold material, wherein a water-soluble inorganic binder in the liquid state having a viscosity of not more than 1000 cP and spherical particles of silicone resin having binder-repellency are added to a refractory aggregate, and kneaded or mixed with the refractory aggregate at room temperature, whereby a coated sand in a wet state which has the spherical particles on its surface is obtained.

(12) The method of producing a mold material according to the above-mentioned mode (11), wherein the water-soluble inorganic binder in the liquid state having a viscosity of not more than 1000 cP is formed by separately adding a predetermined water-soluble inorganic binder and a predetermined amount of water to the refractory aggregate.

(13) A method of manufacturing a casting mold, wherein the mold material according to any one of the above-mentioned modes (1) to (10) is filled in a heated forming mold, and held within the forming mold so as to be solidified or cured, whereby the desired casting mold is obtained.

As described above, in the mold material according to the invention, the water-soluble inorganic binder in the liquid state having a low degree of viscosity and the spherical particles of silicone resin having binder-repellency are mixed to the refractory aggregate to form the mold material in the wet state, such that the spherical particles of silicone resin are present on the surface of a layer of the water-soluble inorganic binder formed around the refractory aggregate. Thus, particles of the mold material are contacted with each other via the spherical particles of silicone resin on their surfaces, to thereby effectively reduce friction between the particles of the mold material. As a result, the fluidity of the mold material is remarkably improved, and the fillability of the mold material into a forming cavity of a forming mold for casting is also effectively improved. Furthermore, the particles of the mold material move to reduce gaps between themselves after filled, resulting in a further improved filling rate of the forming mold.

In addition, the spherical particles of silicone resin having binder-repellency exist on the surfaces of the particles of the mold material, and move to the surface of the water-soluble inorganic binder layer, whereby a casting mold having excellent strength and improved mold-releasability is advantageously obtained from the mold material. In the casting process employing the casting mold formed of the mold material, the casting mold exhibits improved collapsibility, and a casting surface of a cast product to be obtained is effectively improved, that is, a quite smooth casting surface is achieved. Furthermore, sand adhesion, that is, adhesion of the particles of the mold material, to the cast product is also effectively inhibited or reduced, thereby permitting an advantageous improvement of the quality of the cast product.

DETAILED DESCRIPTION OF THE INVENTION

Figure 1:
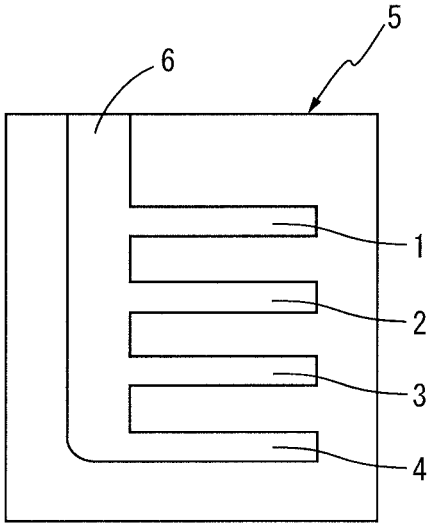
FIG. 1 is a schematic frontal view showing the parting surface of one of the mold halves constituting a forming mold used for evaluation of fluidity at filling of a mold material.

Meanwhile, a mold material including a refractory aggregate and a water-soluble inorganic binder is classified into a mold material in a dry state and a mold material in a wet state, depending on its state after production. The present invention relates to the mold material (coated sand) in the wet state, in which the water-soluble inorganic binder exhibits adhesiveness and the entirety of the mold material is moisturized in appearance. The mold material in the wet state is filled in a forming mold (forming cavity), and heated and dried in the forming mold, for example. Thus, solidification or curing reaction progresses in the forming mold, whereby a desired casting mold is formed. Whether a mold material shows the dry state or the wet state depends on a water content or moisture percentage with respect to a solid content of the water-soluble inorganic binder in the mold material. The water content at which a mold material shows the dry state or the wet state varies according to a kind of the water-soluble inorganic binder. For example, where the water-soluble inorganic binder is a water glass, a mold material having a water content equivalent to 5-55% by mass of the solid content of the water glass shows the dry state, while a mold material having a water content equivalent to more than 55% by mass of the solid content of the water glass shows the wet state.

The mold material (coated sand) in the wet state intended in the invention indicates a mold material (coated sand) not having fluidity at room temperature, and, regardless of its water content, whose value of dynamic angle of repose cannot be obtained upon measurement. The dynamic angle of repose is measured as follows. The mold material (coated sand) is accommodated in a cylinder whose one end has a transparent and planar surface (for example, the mold material is accommodated in a container having a diameter of 7.2 cm and a height of 10 cm, such that the volume of the mold material accommodated in the container is equal to the half of the volume of the container). The container is rotated at a constant speed (for example, at 25 rpm), whereby a layer of the mold material flowing within the cylinder has a flat inclined surface. Here, the angle between the inclined surface and a horizontal plane is the dynamic angle of repose. Thus, when the mold material (coated sand) is wet and does not flow in the cylinder so that the flat inclined surface of the layer of the mold material (coated sand) is not formed, the dynamic angle of repose cannot be measured. In this case, the mold material (coated sand) is referred to as the mold material in the wet state.

The refractory aggregate constituting the mold material in the wet state according to the invention is a refractory material which serves as a base material of the casting mold. Any one of the various refractory particulate or powder materials conventionally used for the casting mold may be used as the refractory aggregate. Specific examples of the refractory aggregate include: silica sand; a regenerated silica sand; special sands such as alumina sand, olivine sand, zircon sand and chromite sand; slag particles such as ferrochromium slag, ferronickel slag and a converter slag; artificial particles such as alumina particles and mullite particles, and regenerated particles thereof; alumina ball; and magnesia clinker. The above-mentioned refractory aggregates may be: a new or fresh sand; a regenerated or reclaimed sand which has been used once or a plurality of times as a molding sand to form the casting mold; or a mixture of the regenerated or reclaimed sand and the new or fresh sand. The refractory aggregate generally has a particle size of about AFS 40-130, and preferably 60-110.

Among the above-mentioned refractory aggregates, spherical aggregates are recommended for advantageously achieving the object of the invention. In particular, a refractory aggregate having a coefficient of angularity of not more than 1.2, and more preferably a coefficient of angularity within a range of 1.0-1.1, is preferred. Using the refractory aggregate having the coefficient of angularity of not more than 1.2 contributes to an improvement of fluidity and ease of filling (fillability) of the mold material, and an increase of contact points between the particles of the refractory aggregate, whereby amounts of the binder and additives required for achieving a desired degree of strength can be reduced. Here, the coefficient of angularity of the aggregate used here, which is also called an index of angularity, is employed as one of the standards defining the external shape of a particle. A particle shape becomes closer to a sphere (true sphere) as the coefficient of angularity of the particle approaches to 1. The coefficient of angularity is defined by a value calculated from a surface area measured by various known methods. For example, the value of the coefficient of angularity is obtained by measuring an actual surface area of 1 g of the sand particles of the aggregate with a measuring device for determining the surface area of sand (available from Georg Fischer Ltd.), and dividing the obtained actual surface area by a theoretical surface area of the particles. The theoretical surface area is a surface area obtained on the supposition that all the sand particles of the aggregate are spherical.

The water-soluble inorganic binder used in the mold material according to the invention is suitably selected from various known binders. Specifically, a binder containing, as its main component, at least one selected from the group comprising a water glass, sodium chloride, sodium phosphate, sodium carbonate, sodium vanadate, sodium aluminum oxide, potassium chloride, potassium carbonate, magnesium sulfate, aluminum sulfate, sodium sulfate, nickel sulfate and manganese sulfate is advantageously used. Among them, the water glass and a binder containing the water glass as its main component are particularly preferred in view of their handling ease and the strength of a finally-obtained casting mold. The water glass is an aqueous solution of a water-soluble silicate compound including, for example, sodium silicate, potassium silicate, sodium metasilicate, potassium metasilicate, lithium silicate and ammonium silicate. Among the above-mentioned water-soluble silicate compounds, sodium silicate (silicate of soda) is preferably used in the invention. In addition, the binder may contain any water-soluble binder, for example a thermosetting resin, a saccharide, a protein, a synthetic polymer, a salt and an inorganic polymer, as long as the binder contains the water glass as the main component. Where another water-soluble binder is contained together with the water glass, the ratio of the water glass in the entire binder is preferably not less than 60% by mass, more preferably not less than 80% by mass, and further preferably not less than 90% by mass.

Sodium silicate is generally classified into No. 1 to No. 5 based on its $SiO_2/Na_2O$ molar ratio. Specifically described, sodium silicate No. 1 has the molar ratio $SiO_2/Na_2O$ within a range between 2.0 and 2.3, sodium silicate No. 2 has the molar ratio $SiO_2/Na_2O$ within a range between 2.4 and 2.6, sodium silicate No. 3 has the molar ratio $SiO_2/Na_2O$ within a range between 2.8 and 3.3, sodium silicate No. 4 has the molar ratio $SiO_2/Na_2O$ within a range between 3.3 and 3.5, and sodium silicate No. 5 has the molar ratio $SiO_2/Na_2O$ within a range between 3.6 and 3.8. Among these, the sodium silicates No. 1 to No. 3 are also specified in JIS-K-1408. Any one or a mixture of the above-mentioned sodium silicates may be used in the invention. It is possible to control the molar ratio $SiO_2/Na_2O$ by mixing at least two kinds of sodium silicate.

In the invention, the sodium silicate constituting the water glass used as the binder generally has a molar ratio $SiO_2/Na_2O$ not smaller than 1.9, preferably not smaller than 2.0, and more preferably not smaller than 2.1, in order to effectively obtain the mold material according to the invention. Among the sodium silicates classified as described above, the sodium silicates equivalent to Nos. 1 to 3, more preferably Nos. 1 and 2, and further preferably No. 2 are advantageously used. The sodium silicates Nos. 1 to 3 give the mold material having satisfactory properties, with a high degree of stability, within a wide range of concentration of these sodium silicates in the water glass. To achieve a high degree of mold strength, the sodium silicates Nos. 1 and 2 are selected; and considering the balance of the properties of an obtained casting mold such as moisture resistance as a whole, the sodium silicate No. 2 is selected. The upper limit of the molar ratio $SiO_2/Na_2O$ is determined according to properties of the water glass in the state of an aqueous solution, generally to be not larger than 3.5, preferably not larger than 3.2, and more preferably not larger than 2.7. Where the molar ratio $SiO_2/Na_2O$ is smaller than 1.9, a large amount of alkali comes to be present in the water glass, thereby increasing solubility of the water glass to water. As a result, it is possible that the coated sand tends to easily deteriorate by moisture absorption. On the other hand, where the molar ratio $SiO_2/Na_2O$ of sodium silicate is larger than 3.5, its solubility to water is low, so that a sufficient surface area of mutual bonding of the particles of the refractory aggregate may not be secured, resulting in a problem of deterioration of the strength of the finally-obtained casting mold.

The water glass used in the invention indicates an aqueous solution of the sodium silicate compound dissolved in water. In the production of the mold material according to the invention, a commercially available aqueous solution of the water glass is used as an undiluted solution as purchased, or as a diluted solution obtained by adding water to the undiluted solution. A nonvolatile content (water glass components) in the water glass is called a solid content, and is calculated by subtracting amounts of volatile substances such as the water and a solvent contained in the water glass, from the amount of the water glass. The thus calculated solid content corresponds to the amount of the soluble silicate compound such as the sodium silicate described above. A higher solid content of the water glass indicates a higher concentration of the silicate compounds in the water glass. Where the aqueous solution of the water glass consists solely of the undiluted solution, the solid content of the water glass corresponds to the amount of a portion of the undiluted solution other than the water contained therein. On the other hand, where the diluted solution obtained by diluting the undiluted solution with water is used as the aqueous solution of the water glass, the solid content of the water glass corresponds to the amount of the components excluding the water contained in the undiluted solution and the water used to dilute the undiluted solution.

The solid content of the water glass is adequately determined depending on the kinds of water glass components (soluble silicate compounds), for example, but preferably held within a range of 20-50% by mass. By preparing the aqueous solution of the water glass containing an adequate amount of water glass components corresponding to the solid content, and mixing or kneading such an aqueous solution with the refractory aggregate, a mixture in which the water glass components are evenly and uniformly distributed over the refractory aggregate can be obtained, so that a desired casting mold can be advantageously manufactured according to the invention. Where the water glass components (soluble silicate compounds) contained in the water glass has an undesirably low concentration such that the total amount of the water glass components (solid content) is less than 20% by mass, it is necessary to heat the mold material in the wet state according to the invention at a higher temperature and for a longer period of time in the forming mold, thereby causing a problem of energy loss, for example. On the other hand, where the solid content of the water glass is excessively high, it is difficult to obtain the mixture in which the water glass components are evenly and uniformly distributed over the refractory aggregate. As a result, there arise problems in improving properties of an intended casting mold. Therefore, the water glass in the state of an aqueous solution is preferably prepared such that its solid content is not more than 50% by mass, that is to say, its water content is not less than 50% by mass.

In addition to the above-mentioned water glass, sodium chloride, sodium phosphate, sodium carbonate, sodium vanadate, sodium aluminum oxide, potassium chloride, potassium carbonate, magnesium sulfate, aluminum sulfate, sodium sulfate, nickel sulfate, manganese sulfate and the like are well known as the water-soluble inorganic binder. These binders are suitably selected and used in the invention so as to exhibit characteristics indicated in JP2012-76115A, for example.

Meanwhile, the above-mentioned aqueous solution of the water-soluble inorganic binder, or the water-soluble inorganic binder in the liquid state, which is used in the invention, is provided as a liquid having a low viscosity of not more than 1000 cP, preferably not more than 750 cP, more preferably not more than 500 cP, and further preferably not more than 300 cP at 25° C., for advantageously improving the strength of the casting mold to be obtained by using the mold material according to the invention. The viscosity of the water-soluble inorganic binder in the liquid state is adequately set to be higher than that of water, and the lower limit of the viscosity is 1 cP in general, preferably 3 cP, more preferably 5 cP, and further preferably 7 cP. By using the water-soluble inorganic binder in the liquid state having a low viscosity, the spherical particles of silicone resin having binder-repellency are allowed to easily move on the surface of the water-soluble inorganic binder in the liquid state coating the refractory aggregate. Where the water-soluble inorganic binder in the liquid state is a liquid such as the water glass, and its viscosity is within the range defined in the invention, it can be used as such. Where the water-soluble inorganic binder is a solid, or its viscosity is outside the range of the invention (over 1000 cP), water is added to the water-soluble inorganic binder so as to obtain a liquid having a viscosity of not more than 1000 cP. Among water-soluble inorganic binders having a viscosity of not more than 1000 cP, a binder having a lower viscosity permits production of a casting mold with higher strength, although the problem is that the mold-releasability of the casting mold gets deteriorated with decrease of the viscosity of the binder. However, the mold material according to the invention permits stably forming a casting mold with high strength and good mold-releasability, as long as the viscosity of the water-soluble inorganic binder in the liquid state is not more than 1000 cP.

In the mold material according to the invention, the above-mentioned various water-soluble inorganic binders are used in an amount of 0.1-2.5 parts by mass, and particularly advantageously 0.2-2.0 parts by mass per 100 parts by mass of the refractory aggregate, in terms of its mass where the binder is a solid, and in terms of its mass of the solid content where the binder is a liquid. Here, the solid content of the water glass is measured in the following manner. First, 10 g of a sample of the water glass is accommodated in a container (length: 9 cm; width: 9 cm; depth: 1.5 cm, not sealed) formed of an aluminum foil, and weighed to thereby obtain a value of the mass of the container accommodating the sample before drying. Subsequently, the container accommodating the sample is placed on a heating plate whose temperature is held at 180±1° C., and left on the heating plate for 20 minutes. The container accommodating the sample is then reversed upside down and held on the heating plate for another 20 minutes. Then, the container accommodating the sample is removed from the heating plate and cooled within a desiccator, and the container is weighed to thereby obtain a value of the mass of the container accommodating the sample after drying. The solid content (% by mass) is calculated according to the following formula:

Solid content (% by mass)={[Mass(g) of the container accommodating the sample after drying−mass(g) of the container]/[Mass(g) of the container accommodating the sample before drying−mass(g) of the container]}×100

Where the water-soluble inorganic binder is used in an undesirably small amount in the mold material in the wet state according to the invention, it is difficult to form a mixture (mold material) in which the water-soluble inorganic binder is evenly and uniformly distributed over the refractory aggregate. On the other hand, where the water-soluble inorganic binder is used in an excessively large amount, there may arise problems such as deterioration of the fluidity of the mold material and degradation of mold-releasability. The above-mentioned problems have harmful influences on the physical properties of the finally-obtained casting mold, and may cause difficulty in removing the molding sand of a casting core (removal of the solidified mold material) after casting of metal.

In the invention, the above-mentioned water-soluble inorganic binder in the liquid state and spherical particles of silicone resin having binder-repellency are added to and mixed with the predetermined refractory aggregate, to thereby obtain the intended mold material in the wet state. Since the spherical particles of silicone resin used here have binder-repellency, they become present on the surfaces of the particles of the mold material to be obtained, that is, the surface of a layer of the water-soluble inorganic binder coating the refractory aggregate. As a result, when the coated sand is made to flow so as to be filled in a forming mold (metal die), the particles of the mold material are allowed to contact with each other via the spherical particles of silicone resin. Thus, friction between the particles of the mold material is effectively reduced, and the fluidity of the mold material is advantageously improved. When forming a casting mold, the water-soluble inorganic binder on the surface of the mold material adheres to a metal blow tank or a passageway of a nozzle in a molding apparatus, resulting in deterioration of the fluidity of the mold material. However, in the mold material according to the invention, the spherical particles of silicone resin on the surfaces of the sand particles are present between a metal surface of members of the molding apparatus and the water-soluble inorganic binder, and exhibit the effect of protecting the metal surface of the molding apparatus. Consequently, adhesion of the mold material to the blow tank and the passageway of the nozzle in the molding apparatus is effectively prevented or reduced. In addition, after the mold material according to the invention is filled in the molding apparatus, the particles of the mold material are allowed to move to reduce gaps between themselves, whereby the fillability of the mold material is further improved.

Since the surfaces of the spherical particles of silicone resin used in the invention are binder-repellent, the spherical particles are easy to move to the surface of the layer of the water-soluble inorganic binder, when being mixed with the water-soluble inorganic binder in the liquid state. The spherical particles thus come to be present on the surface of the water-soluble inorganic binder. In addition, the spherical shape of the particles permits the coated sand to become further slippery, whereby the fluidity of the mold material is further improved. Furthermore, the presence of the spherical particles permits advantageously preventing adhesion of the water-soluble inorganic binder to the forming mold, so that the mold material has an advantage of giving the casting mold obtained therefrom significantly improved releasability from the forming mold. The binder-repellency of the spherical particles of silicone resin gives a further advantage. That is, when a point of adhesion (bridge) is formed between the particles of the aggregate by the water-soluble inorganic binder, the spherical particles move to the surface of a part of the water-soluble organic binder constituting the point of adhesion, that is, move to the periphery of the point of adhesion. The spherical particles are thus effectively prevented from being taken in the inside of the part of the water-soluble organic binder. As a result, the particles of the aggregate are advantageously bonded with each other at the part of the water-soluble organic binder without any impurity, so that the strength of the casting mold to be obtained is effectively secured, thereby contributing to maintenance and an improvement of the strength.

The binder-repellency mentioned in the invention indicates a property of repelling the water-soluble inorganic binder in the liquid state. In the invention, the spherical particles of silicone resin having binder-repellency are defined as follows. Initially, the spherical particles are scattered on a given support so as to form a horizontal plane with the spherical particles, and the water-soluble inorganic binder in the liquid state used for forming the mold material is dripped on the horizontal plane. The spherical particles are defined to have binder-repellency when a contact angle between the drip and the horizontal plane is not less than 90°. The contact angle is preferably not less than 100°, more preferably not less than 120°, and further preferably not less than 125°.

The spherical particles of silicone resin have a shape generally recognized as a sphere, and are not necessarily required to be in the form of a true sphere. Usually, the spherical particles having a sphericity of not less than 0.5, preferably not less than 0.7, and more preferably not less than 0.9 are advantageously used. Here, the sphericity is defined by a mean value of aspect ratios calculated from projected shapes of 10 mutually independent particles arbitrarily selected for observation with a scanning electron microscope. The aspect ratio indicates a ratio of the short diameter to the long diameter.

The spherical particles of silicone resin having binder-repellency used in the invention preferably have a characteristic that its weight reduction ratio is within a range of 5-50%, preferably 10-30%, and more preferably 10-20%, when the spherical particles are subjected to heating in a thermogravimetric/differential thermal analyzer from room temperature to 700° C. in an air atmosphere. Generally, the mold material formed by using the water-soluble inorganic binder has an inherent problem that a casting mold obtained therefrom does not exhibit good collapsibility after the casting mold is used for casting, while such a mold material has an advantage that it does not generate gas because the binder does not include organic components. By adding the spherical particles of silicone resin having binder-repellency according to the invention, the collapsibility of the casting mold can be improved because of gas generated from organic components contained in the spherical particles. To achieve this effect, the above-mentioned weight reduction ratio is preferably set to be not less than 5%. On the other hand, the weight reduction ratio is preferably set to be not more than 50%, to thereby prevent generation of a large amount of gas at the time of casting and gas deficiency in a cast product.

As the spherical particles of silicone resin having binder-repellency described above, particles having a smaller diameter than that of the refractory aggregate are advantageously used. Specifically, the average particle diameter of the particles is within a range of 0.01 μm-50 μm, preferably 0.05 μm-25 μm, more preferably 0.1 μm-10 μm, and further preferably 0.2 μm-3 μm. The spherical particles having the above-mentioned average particle diameter are smaller than the refractory aggregate to be mixed with in the particle size, so that they easily enter into the refractory aggregate, and are uniformly dispersed among the particles of the refractory aggregate. Thus, the spherical particles come to be uniformly present on the surfaces of the particles of the mold material.

In the mold material according to the invention, the spherical particles of silicone resin having binder-repellency are used in an amount of 0.1-500 parts by mass, preferably 0.3-300 parts by mass, more preferably 0.5-200 parts by mass, further preferably 0.75-100 parts by mass, and the most preferably 1-50 parts by mass, per 100 parts by mass of the solid content of the water-soluble inorganic binder constituting the coating layer on the surface of the refractory aggregate. In summary, the effects according to the present invention can be more advantageously achieved by including the spherical particles of silicone resin having the predetermined average particle diameter in the coating layer of the water-soluble inorganic binder which is formed on the refractory aggregate, in the above-mentioned predetermined amount. The average particle diameter is calculated from a particle size distribution measured with a laser diffraction-type particle counter, for example.

The particles of silicone resin used in the invention as described above are not limited, as long as the particles are spherical and have the binder-repellency. It is required only that the spherical resin particles have the binder-repellency on their surface. Thus, the same effect as the invention can be also achieved by using spherical particles whose surfaces alone are coated with a silicone resin having binder-repellency. However, in view of the possibilities of breakage of the spherical particles themselves and peeling off of the coating, spherical particles formed of a single component of a binder-repellent silicone resin are more preferably used. The silicone resin is preferably a resin whose main component is organopolysiloxane, and the organopolysiloxane is more preferably silsesquioxane. Furthermore, particularly preferably, the silsesquioxane is polymethylsilsesquioxane. Where the organopolysiloxane constituting the spherical particles is silsesquioxane, and further the silsesquioxane is polymethylsilsesquioxane, spherical particles to be obtained enjoy an excellent heat resistance along with an effective binder-repellency, because the particles formed of polymethylsilsesquioxane have a higher degree of silicon content. With the above-mentioned properties, the spherical particles are not likely to suffer from thermal decomposition and melting under the heat at the time of molding the casting mold, so that the particles can advantageously maintain their spherical shape even at the time of molding and casting. Consequently, the fillability of the coated sand and the effect of improving the strength of the casting mold are advantageously maintained. Besides, the effects of preventing sand adhesion and improving the casting surface can be further advantageously exhibited at the time of casting, because the above-mentioned spherical particles permit reduction of odor and smoke at the time of molding.

The mold material according to the invention suitably contains various additives such as a curing agent and a curing accelerator, as known well, and further, preferably contains at least one nitrate selected from the group consisting of alkali metal salts and alkaline earth metal salts of nitric acid for improving the collapsibility of the casting mold obtained from the mold material. The nitrate is added to and mixed with the refractory aggregate along with the above-mentioned water-soluble inorganic binder and the spherical particles of silicone resin. The amount of the nitrate is preferably 0.5-30 parts by mass, more preferably 1-25 parts by mass, and particularly preferably 3-20 parts by mass, per 100 parts by mass of the solid content of the water-soluble inorganic binder in the mold material. Where the amount of the nitrate is too small, the above-mentioned effects may not be enjoyed advantageously. On the other hand, an excessively large amount of nitrate does not contribute to a further improvement of the effects corresponding to the increase of the amount, and is not desirable in view of cost-effectiveness. Among the nitrates, sodium nitrate and potassium nitrate, which are the alkali metal nitrates, and calcium nitrate and magnesium nitrate, which are the alkaline earth metal nitrates, are suitable, and any one or a mixture of the above-mentioned kinds of nitrate can be used. Specifically, where the water-soluble inorganic binder is the water glass, the alkali metal salts of nitric acid are more preferred, and among them, sodium nitrate and potassium nitrate are advantageously used, in view of their high solubility to the water glass.

In the mold material according to the invention, a moisture-resistance improving agent is preferably contained further together with the above-mentioned spherical particles of silicone resin. Where the mold material contains the moisture-resistance improving agent, synergism between a secondary effect of the binder-repellency of the spherical particles and the effect of the moisture-resistance improving agent is exhibited at the time of forming the casting mold so as to further improve the moisture-resistance of the finally-obtained casting mold.

Any moisture-resistance improving agent conventionally used in the mold material may be used in the invention, as long as it does not hinder the effect of the invention. Specific examples of the moisture-resistance improving agent include: carbonates such as zinc carbonate, basic zinc carbonate, ferrous carbonate, manganese carbonate, copper carbonate, aluminum carbonate, barium carbonate, magnesium carbonate, calcium carbonate, lithium carbonate, potassium carbonate and sodium carbonate; borates such as sodium tetraborate, potassium tetraborate, lithium tetraborate, ammonium tetraborate, calcium tetraborate, strontium tetraborate, silver tetraborate, sodium metaborate, potassium metaborate, lithium metaborate, ammonium metaborate, calcium metaborate, silver metaborate, copper metaborate, lead metaborate and magnesium metaborate; sulfates such as sodium sulfate, potassium sulfate, lithium sulfate, magnesium sulfate, calcium sulfate, strontium sulfate, barium sulfate, titanium sulfate, aluminum sulfate, zinc sulfate and copper sulfate; phosphates such as sodium phosphate, sodium hydrogen phosphate, potassium phosphate, potassium hydrogen phosphate, lithium phosphate, lithium hydrogen phosphate, magnesium phosphate, calcium phosphate, titanium phosphate, aluminum phosphate and zinc phosphate; hydroxides such as lithium hydroxide, magnesium hydroxide, calcium hydroxide, strontium hydroxide, barium hydroxide, aluminum hydroxide and zinc hydroxide; and oxides of silicon, zinc, magnesium, aluminum, calcium, lithium, copper, iron, boron and zirconium. Among them, the basic zinc carbonate, ferrous carbonate, lithium carbonate, sodium tetraborate, lithium tetraborate, potassium metaborate, lithium sulfate and lithium hydroxide particularly advantageously improve the moisture resistance of the casting mold, when the water glass is used as the water-soluble inorganic binder. Specifically, the carbonates and the borates, which permit an improvement of the moisture resistance particularly easily, are preferably used. Any one or a mixture of the moisture-resistance improving agents including the above-mentioned ones may be used in the invention. It is noted that the above-mentioned moisture-resistance improving agents include the compounds which can be used as the water-soluble inorganic binder. Such compounds can exhibit the effect as the moisture-resistance improving agent when the water-soluble inorganic binder is a compound other than themselves.

The moisture-resistance improving agent is used generally in an amount of 0.5-50 parts by mass, preferably 1-20 parts by mass, and more preferably 2-15 parts by mass in total, per 100 parts by mass of the solid content of the water-soluble inorganic binder in the liquid state. It is preferred to use the moisture-resistance improving agent in an amount of not less than 0.5 part by mass to enjoy its advantageous effect. On the other hand, an excessively large amount of moisture-resistance improving agent inhibits the bonding effect of the water-soluble inorganic binder, resulting in deterioration of the strength of the finally-obtained casting mold. Thus, the amount of addition is preferred to be not more than 50 parts by mass.

The mold material according to the invention may contain a suitable surfactant. The surfactant is preferably contained in the mold material according to the invention in an amount of 0.1-20.0 parts by mass, more preferably 0.5-15.0 parts by mass, and particularly preferably 0.75-12.5 parts by mass, per 100 parts by mass of the solid content of the water-soluble inorganic binder. Where the amount of the surfactant is too small, the above-mentioned effects may not be enjoyed advantageously. On the other hand, an excessively large amount of surfactant does not contribute to a further improvement of the effects corresponding to the increase of the amount, and is not desirable in view of cost-effectiveness. In the invention, any of cationic, anionic, ampholytic, nonionic, silicone-based and fluorocarbon-based surfactants can be used as the surfactant.

Specifically described, examples of the cationic surfactant include aliphatic amine salts, aliphatic quaternary ammonium salts, benzalkonium salts, benzethonium chloride, pyridinium salts and imidazolinium salts. Examples of the anionic surfactant include fatty acid soaps, N-acyl-N-methylglycine salt, N-acyl-N-methyl-β-alanine salt, N-acyl glutamic acid salt, alkyl ether carboxylate, acyl peptide, alkylsulfonate, alkylbenzene sulfonate, alkylnaphthalene sulfonate, dialkyl sulfosuccinate, alkyl sulfoacetate, α-olefin sulfonate, N-acylmethyltaurine, sulfated oils, higher alcohol sulfate, secondary higher alcohol sulfate, alkyl ether sulfate, secondary higher alcohol ethoxysulfate, polyoxyethylene alkylphenyl ether sulfate, monoglysulfate, fatty acid alkylolamide sulfate, alkyl ether phosphate and alkyl phosphate. Furthermore, examples of the ampholytic surfactant include carboxy betaine, sulfobetaine, aminocarboxylate and imidazolinium betaine. In addition, examples of the nonionic surfactant include polyoxyethylene alkyl ether, polyoxyethylene sec-alcohol ether, polyoxyethylene alkyl phenyl ether (for example, EMULGEN 911), polyoxyethylene sterolether, polyoxyethylene lanolin derivatives, polyoxyethylene polyoxypropylene alkyl ether (for example, NEWPOL PE-62), polyoxyethylene glycerine fatty acid ester, polyoxyethylene castor oil, hydrogenated castor oil, polyoxyethylene sorbitan fatty acid ester, polyoxyethylene sorbitol fatty acid ester, polyethylene glycol fatty acid ester, fatty acid monoglyceride, polyglyceryl fatty acid ester, sorbitan fatty acid ester, propylene glycol fatty acid ester, sucrose fatty acid ester, fatty acid alkanolamide, polyoxyethylene fatty acid amide, polyoxyethylene alkylamine, alkylamine oxide, acetylene glycol and acetylene alcohol.

Among various surfactants, one having a siloxane structure as a nonpolar portion is called the silicone-based surfactant, and one having a perfluoroalkyl group is called the fluorocarbon-based surfactant. Examples of the silicone-based surfactant include: polyester-modified silicone; silicone modified by polyester having an acrylic group at an end; polyether-modified silicone; silicone modified by polyether having an acrylic group at an end; polyglycerine-modified silicone; and aminopropyl-modified silicone. Examples of the fluorocarbon-based surfactant include perfluoroalkyl sulfonate, perfluoroalkyl carbonate, perfluoroalkyl phosphate, perfluoroalkyl trimethylammonium salt, perfluoroalkyl ethylene oxide adduct and an oligomer containing a perfluoroalkyl group.

Any one or a mixture of the above-mentioned various surfactants may be used in the invention. However, some of the surfactants react with the water-soluble inorganic binder, and may suffer from deterioration or a loss of the surface-activating ability as the time passes. For this reason, where the water glass is used as the water-soluble inorganic binder, for example, the anionic surfactant, the nonionic surfactant and the silicone-based surfactant, which do not react with the water glass, are advantageously used.

The mold material according to the invention may contain a moisturizer. The moisturizer permits, at the time of forming the casting mold, stable retention of moisture of the moisturized mold material wetted by water, until the mold material is solidified or cured by heating. The amount of the moisturizer in the invention is preferably 0.1-20.0 parts by mass, and more preferably 0.5-15.0 parts by mass, per 100 parts by mass of the solid content of the water-soluble inorganic binder. Examples of the moisturizer include polyhydric alcohols, water-soluble polymers, hydrocarbons, saccharides, proteins and inorganic compounds.

Specific examples of the polyhydric alcohol include ethylene glycol, diethylene glycol, triethylene glycol, polyethylene glycol, polypropylene glycol, dipropylene glycol, propylene glycol, butylene glycol, 1,2-butanediol, 1,2-pentanediol, 1,5-pentanediol, 1,2-hexanediol, 2-ethyl-1,3-hexanediol, 1,6-hexanediol, 1,2-heptanediol, 1,2-octanediol, 1,2,6-hexanetriol, thioglycol, hexylene glycol, glycerine, trimethylolethane and trimethylolpropane. The water-soluble polymeric compound specifically indicates a compound containing 5-25 alcoholic hydroxyl groups per molecular weight of 1000. Examples of the water-soluble polymeric compound include vinyl alcohol-based polymers such as polyvinyl alcohol and various modified products thereof; cellulose derivatives such as alkyl cellulose, hydroxylalkyl cellulose, alkylhydroxyalkyl cellulose, carboxymethyl cellulose, hydroxyethyl cellulose and hydroxypropyl methyl cellulose; starch derivatives such as alkyl starch, carboxymethyl starch and oxidized starch; and water-absorptive polymers such as sodium polyacrylate. Examples of the hydrocarbon include aliphatic hydrocarbon, alicyclic hydrocarbon, aromatic hydrocarbon, petroleum ether, petroleum benzyl, tetralin, decalin, tertiary amyl benzene, dimethylnaphthalene. Examples of the saccharide include monosaccharides, oligosaccharides and polysaccharides such as dextrin. Among them, the monosaccharide is a saccharide which cannot be decomposed into a simpler saccharide by hydrolysis. A monosaccharide used here is preferably triose (a saccharide having three carbon atoms) through decose (a saccharide having 10 carbon atoms), and more preferably hexose (a saccharide having six carbon atoms). The protein include gelatin. In addition, examples of the inorganic compound include saline, sodium sulfate, calcium chloride, magnesium chloride and silicate. Any one or a mixture of the above-indicated kinds of moisturizer may be used in the invention.

The mold material according to the invention may contain particles of an inorganic metal oxide such as silicon dioxide, aluminum oxide and titanium oxide, having an average particle diameter of 0.1-20 μm. The particles of an inorganic metal oxide contained in the mold material contribute to a more effective improvement of fillability of the mold material in the forming mold (forming cavity) at the time of forming the casting mold. The particles are contained in the mold material preferably in an amount of 0.1-50.0 parts by mass, and more preferably 0.5-30.0 parts by mass, per 100 parts by mass of the solid content of the water-soluble inorganic binder. The average particle diameter of the particles is calculated from a particle size distribution measured with a laser diffraction-type particle counter, for example.

The particles of an inorganic metal oxide used in the invention are preferably spherical, and are not necessarily required to be in the form of a true sphere. Generally, the particles having a sphericity of not less than 0.5, preferably not less than 0.7, and more preferably not less than 0.9 are advantageously used. Here, the sphericity is defined by a mean value of aspect ratios calculated from projected shapes of 10 mutually independent particles arbitrarily selected for observation with a scanning electron microscope. The aspect ratio indicates a ratio of the short diameter to the long diameter.

The mold material according to the invention may suitably contain various other known additives as necessary. For adding such additives to the mold material, one method to be employed is adding a given additive in advance to the water-soluble inorganic binder in the liquid state, and kneading or mixing the binder containing the additive with the refractory aggregate. Another method is adding a given additive to the refractory aggregate independently of the water-soluble inorganic binder, and uniformly kneading or mixing the entirety of the additive, the binder and the refractory aggregate.

It is effective to use, as one of the above-mentioned other additives, a coupling agent which strengthens a bond between the refractory aggregate and the water-soluble inorganic binder. Examples of the coupling agent include silane coupling agents, zirconate coupling agents and titanate coupling agents. Also, it is effective to use a lubricant which serves to improve fluidity of the mold material. Examples of the lubricant include: waxes such as paraffin wax, synthetic polyethylene wax and montan wax; fatty acid amides such as stearic acid amide, oleic acid amide and erucic acid amide; alkylene fatty acid amides such as methylene-bis-stearic acid amide and ethylene-bis-stearic acid amide; stearic acid; stearyl alcohol; metal stearates such as lead stearate, zinc stearate, calcium stearate and magnesium stearate; glyceryl monostearate; stearyl stearate; and hydrogenated oils. Furthermore, it is possible to use a mold release agent such as paraffins, waxes, light oils, machine oils, spindle oils, insulating oils, waste oils, plant oils, fatty acid esters, organic acids, graphite particulates, mica, vermiculite, fluorine-based mold release agents, and silicone-based mold release agents like silicone oil. Each of the above-indicated additives is generally contained in the mold material in an amount of not more than 5% by mass, and more preferably not more than 3% by mass, with respect to the solid content of the water-soluble inorganic binder.

In the invention, the mold material in the wet state not having fluidity at room temperature is produced according to the following method in general: initially, the water-soluble inorganic binder in the state of an aqueous solution as the binder, the spherical particles of silicone resin having binder-repellency, and other additives used as necessary, are uniformly kneaded or mixed with the refractory aggregate of the room temperature, so as to obtain the mold material (coated sand) in the wet state not having fluidity at room temperature formed of a mixture in which the refractory aggregate, the water-soluble inorganic binder in the state of an aqueous solution and the spherical particles of silicone resin (and other additives) are uniformly mixed together. The obtained mold material (coated sand) in the wet state not having fluidity at room temperature has a water content suitably adjusted as necessary, such that the mold material shows the wet state. The water content of the mold material (coated sand) is set to be more than 55% by mass, preferably 70-900% by mass, and further preferably 95-500% by mass, with respect to the solid content of the water-soluble inorganic binder. The mold material (coated sand) in the wet state having the water content adjusted as described above can effectively avoid being dried by blow air at the time of filling in the forming mold during mold formation, and being prevented from filling to the forming mold, while retaining moisture as the mold material (coated sand) in the wet state. In addition, the mold material (coated sand) can impart excellent properties to the casting mold manufactured therefrom.

In the production process of the mold material in the wet state according to the invention, the spherical particles of silicone resin having binder-repellency may be simultaneously added to and kneaded or mixed with the refractory aggregate and the water-soluble inorganic binder, or may be added to the refractory aggregate and the water-soluble inorganic binder separately at the time of kneading. Furthermore, it is also possible that the spherical particles are kneaded with the other components with a predetermined time lag. In producing the mold material in the wet state according to the invention, the water-soluble inorganic binder in the state of an aqueous solution which is used as the binder is dissolved in water in advance of its use, in the case where the water-soluble inorganic binder is a solid. Also the water-soluble inorganic binder in the liquid state may be dissolved in water so as to adjust its viscosity to be within the range specified in the invention. The water can be mixed with the water-soluble inorganic binder in advance, or added to the refractory aggregate independently of the water-soluble inorganic binder at the time of kneading or mixing with the refractory aggregate. Meanwhile, in the case where the water-soluble inorganic binder and water are added independently of each other at the time of kneading or mixing, the viscosity of the water-soluble binder in the liquid state is determined on the basis of a viscosity at the time when the water-soluble inorganic binder and water which are added independently of each other are mixed. Thus, also in the case where the water-soluble inorganic binder in the solid state and the water are added independently of each other at the time of kneading or mixing, for example, the water-soluble inorganic binder is considered to be used in the liquid state. In this case, the water-soluble inorganic binder meets the requirements of the invention if the viscosity of a liquid obtained by dissolving the water-soluble inorganic binder in the solid state in water is not more than 1000 cP.

In manufacturing an intended casting mold by using the mold material (coated sand) in the wet state not having fluidity at room temperature according to the invention, a method including the following steps is advantageously employed: the step of filling the mold material in a forming cavity of a forming mold which gives the intended casting mold; the step of heating the forming mold to a temperature of 80-300° C., preferably 90-250° C., and more preferably 100-200° C.; and holding the filled mold material in the forming mold until the mold material is dried. By heating the forming mold to the above-mentioned range of temperature, moisture-resistance of the finally-obtained casting mold is advantageously improved, while drying of the mold material is advantageously promoted. It is acceptable to blow heated air or superheated steam into the forming mold while the mold material is held in the forming mold, to thereby promote drying of the mold material. Furthermore, carbon dioxide ($CO_2$ gas), esters and the like in the form of gas or mist can be passed through the forming mold as a curing accelerator, to thereby further promote solidification or curing of the mold material (filled phase).

That is, when the mold material (coated sand) in the wet state not having fluidity at room temperature is filled in and held within the cavity of the heated forming mold, particles of the refractory aggregate are bonded with each other via the water-soluble inorganic binder, because the mold material constituting the filled phase in the cavity is in the wet state. Thus, a mass (united body) of the mold material having a shape of an integral casting mold is formed. It is noted that the water-soluble inorganic binder is usually solidified due to its water evaporation to dryness when no additive is contained, or is cured when an oxide or a salt is contained as a curing agent. In the present invention, a mass (united body) of the mold material includes both of a mere solidified product, and a cured product which has been cured with a curing agent. In addition, it is to be understood that the description "solidified product" in the present description includes also the meaning of "cured product".

Examples of the curing accelerator described above include carbon dioxide and various esters such as methyl formate, ethyl formate, propyl formate, γ-butyrolactone, β-propiolactone, ethyleneglycol diacetate, diethyleneglycol diacetate, glycerin diacetate, triacetin and propylenecarbonate. Any one or a mixture of the above-indicated curing accelerator may be used in the invention.

When manufacturing an intended casting mold by using the mold material according to the invention, various known molding methods can be employed in addition to the above-mentioned methods. One example of the methods is a multilayer molding operation, in which a three-dimensional casting mold is directly formed by successively superposing a plurality of layers of the mold material on each other, and curing a portion of the layers corresponding to the shape of an intended casting mold.

EXAMPLES

To clarify the present invention more specifically, some examples and comparative examples of the present invention will be described. However, it is to be understood that the present invention is by no means limited by the details of the illustrated examples and comparative examples. In the examples and comparative examples described below, "%" and "part" respectively indicate "% by mass" and "part by mass", unless otherwise specified. Measurements and evaluations are performed as follows, with respect to properties of resin particles and binders used in the examples and comparative examples, properties of the obtained mold materials (coated sands: CSs), and various properties recognized in a molding test and a casting test with respect to each of the CSs.

(1) Measurement of an Average Particle Diameter

The average particle diameter of the particles used in the Examples and Comparative Examples is measured with a MICROTRAC particle size distribution analyzer manufactured by Nikkiso Co., Ltd., JAPAN (Trade name: MT3200II), such that a value of the particle diameter at 50% in the cumulative distribution of the particle size is regarded as the average particle diameter ($D_{50}$).

(2) Measurement of a Weight Reduction Ratio of Resin Particles by Thermo-Gravimetry (TG)

A sample of the resin particles accommodated in a platinum cell is heated from the room temperature to 930° C. by using a differential thermogravimetric analyzer (TG-DTA Thermoplus2 TG8120 manufactured by Rigaku Corporation, JAPAN; air flow rate: 500 ml/min, temperature rising rate: 10° C./min, and platinum cell with a diameter of 0.5 cm×a height of 0.5 cm). The sample is measured of its weight reduction ratio during the temperature rising from the room temperature to 700° C.

(3) Measurement of a Contact Angle

A level of the resin particles in a glass Petri dish is provided to form a horizontal plane, and a drop of a liquid of each water-soluble inorganic binder used for producing a mold material is dripped on the horizontal plane by means of a syringe. The drop formed of the dripped water-soluble inorganic binder is observed with a digital microscope BS-D800011 manufactured by Sonic Co., Ltd. (JAPAN), whereby the contact angle between the horizontal plane formed of the resin particles and the drop formed of the dripped water-soluble inorganic binder is measured. In the case where the water-soluble inorganic binder permeates into the resin particles and does not form a drop, the contact angle cannot be measured.

(4) Measurement of Viscosity of a Binder

The measurement is conducted according to "9. Method for viscosity measurement by means of single-cylinder rotational viscometer" defined in "Methods for viscosity measurement of liquid" of the JIS-Z-8803 (2011). The viscosity (cP) at 25° C. is measured with respect to the water-soluble inorganic binder in the liquid state used in the Examples and the Comparative Examples, by using an apparatus employing the same principle as that of the apparatus described in the above-mentioned method.

(5) Measurement of a Filling Rate

A casting mold having a width of 1.0 cm, a height of 1.0 cm and a length of 8.0 cm is obtained in each of the Examples and the Comparative Examples, and the obtained casting mold is used as a sample. A ratio of the specific gravity of the casting mold to the true specific gravity of the aggregate is calculated as a percentage. The specific gravity of the sample is obtained by dividing the mass of the sample with the volume of the sample.

$$\text{Filling rate (\% by mass)} = \{[\text{mass(g) of the sample}/\text{volume(cm}^3\text{) of the sample}]/\text{true specific gravity(g/cm}^3\text{) of the aggregate}\} \times 100$$

(6) Evaluation of Mold-Releasability

Five times of mold formation are successively performed by using a metal forming mold used for the following evaluation of fluidity at filling, with its forming cavity not being coated with a mold release agent. Then, ease of mold release after the successive mold formation is visually examined. The standard of the evaluation is as follows. It is noted that samples which are evaluated as Average or Good are considered to meet the requirements of the invention.

Good: Easily released from the forming mold without any problem

Average: Released from the forming mold without a significant problem in spite of a slight releasing resistance Poor: Some problems in releasing from the forming mold; breakage or crack occurred in the sample Very poor: Some problems in releasing from the forming mold; breakage or crack occurred in the sample, and adhesion of the binder and the aggregate recognized in the forming mold (7) Evaluation of Fluidity at Filling Each of the CSs obtained in the Examples and Comparative Examples is filled in a forming mold consisting of one mold half 5 having a parting surface shown in FIG. 1 and the other mold half 5 having the symmetrical parting surface, through a filling inlet 6 and at a blowing pressure of 0.3 MPa. The CS is subjected to mold formation at a temperature of 150° C. of the forming mold for 180 seconds so as to obtain a casting mold, and the obtained casting mold is measured with respect to its mass (g). Subsequently, in the formed casting mold, the state of filling of the CS into passages 1 to 4 in a cavity of the forming mold is visually observed, and evaluated according to the following standard. Casting molds in which the passages 3 to 4 are sufficiently filled and the passages 1 and 2 are at least partly filled are considered to meet the requirements of the invention.

Good: Filled

Average: Almost filled but with some voids

Figure 2:
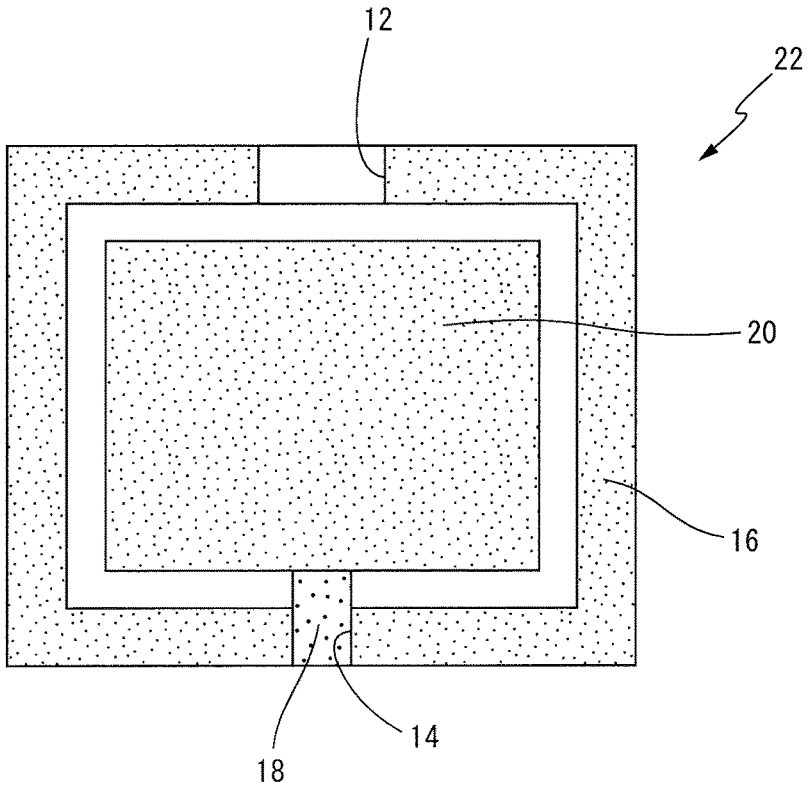
FIG. 2 is a schematic longitudinal view showing a sand mold for casting test used for measuring collapsibility of a core in Examples.
Figure 3:
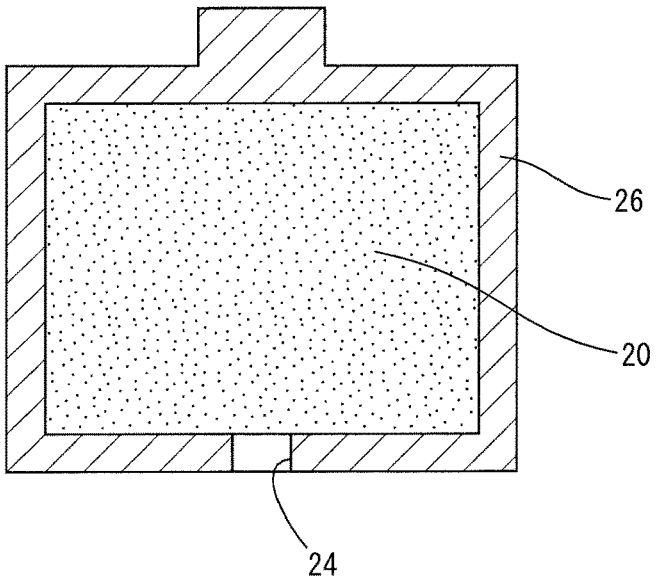
FIG. 3 is a schematic longitudinal view showing an aluminum alloy cast product obtained in the Examples, which contains waste core sand.

Poor: Not filled and the corresponding part of the casting mold is not formed (8) Evaluation of Collapsibility Initially, as shown in FIG. 2, a half-split hollow main mold 16 (diameter of cavity: 6 cm; height: 6 cm) is formed from a normal temperature self-curing sand in advance, such that the main mold 16 has a molten metal inlet 12 in its upper part, and a baseboard fixing portion 14 in its lower part. Then, a circular non-hollow core 20 (diameter: 5 cm; height: 5 cm) having a baseboard 18, which circular non-hollow core 20 is produced by using each CS, is accommodated in the half-split hollow main mold 16. The baseboard 18 is joined and fixed with the baseboard fixing portion 14, and two pieces of the half-split main mold 16 are joined and fixed with each other, whereby a sand mold 22 for casting test is manufactured. To prevent leakage of molten metal during casting, the joined main mold 16 is clamped in a vise, or wound by a wire to be firmly fixed. Next, molten metal of an aluminum alloy (temperature: 710+5° C.) is poured to the sand mold 22 for casting test through the molten metal inlet 12. After the molten metal is solidified, the main mold 16 is broken, so as to take out a cylindrical cast product 26 shown in FIG. 3. The cast product 26 is cooled to the room temperature, and subsequently subjected to a strike by an air hammer, so that the circular non-hollow core 20 is discharged. At the time of discharge, a chipping pressure is set to be 0.3 MPa, and the strike is performed against the cast product 26 every three seconds by an air hammer. Ease of discharge of the CS constituting the circular non-hollow core 20 (hereinafter referred to as a core CS) from the cast product 26 is evaluated based on the number of strike performed before the discharge is completed.

(9) Evaluation of a State of Sand Adhesion after Casting Process

Molten metal is poured to the sand mold 22 for casting test according to the above-mentioned (8) Evaluation of collapsibility, and solidified. Subsequently, the main mold 16 is broken, so as to take out the cylindrical cast product 26 shown in FIG. 3. After the cast product 26 is cooled to the room temperature, the cast product is cut to the half with a lathe or the like, together with the core accommodated in its inside. Then the core is removed, and the state of adhesion of the core sand (CS) to the cast product is visually observed, and evaluated according to the following standard. The examples evaluated as Average or Good according to the following standard are considered to meet the requirement of the invention.

Good: No sand adhesion recognized

Average: Sand adhesion recognized only in a part of the surface of the cast product Poor: Sand adhesion recognized over the entirety of the surface of the cast product

(10) Evaluation of Surface Roughness of the Cast Product

Each of the cast products evaluated with respect to the state of sand adhesion in the above-mentioned (9) Evaluation of a state of sand adhesion after casting process is evaluated according to the following standard on the surface roughness, which is visually observed and felt by the finger. In the case where the sand (CS) adheres to the surface of the cast product, the surface of the cast product is evaluated after removing the adhered sand (CS) by a brass brush and the like. The examples evaluated as Average or Good according to the following standard are considered to meet the requirement of the invention.

Good: No roughness visually observed, and no stuck felt on fingertip

Average: Some roughness visually observed, but no stuck felt on fingertip

Poor: Remarkable roughness visually observed, and some stuck felt on fingertip

(11) Measurement of Flexural Strength of the Casting Mold

The sample obtained in the above-mentioned (5) Measurement of a filling rate by using each of the CSs is measured of its breaking load with a measuring device (a digital molding sand strength tester available from Takachiho Seiki Co., Ltd., JAPAN). Flexural strength is calculated from the measured breaking load according to the following formula. It is noted that the breaking load is measured with respect to the sample of the room temperature after 1 hour from its formation.

$$\text{Flexural strength}(N/\text{cm}^2)=1.5\times LW/ab^2$$

[L: length (cm) of a support span, W: breaking load (N), a: width (cm) of the sample, b: thickness (cm) of the sample]

(12) Measurement of an Amount of Gas Generation

The amount of gas generation is measured with a PGD-type gas pressure measuring device (manufactured by Georg Fischer Ltd.) as follows, at a temperature of 700° C. First, the temperature in the furnace is raised to 700° C. 1 g of a test piece shaved off from the sample obtained by using each CS in the above-mentioned (5) Measurement of a filling rate is charged in a cylindrical copper sample tube (diameter: about 0.7 cm, height: 7.7 cm). The sample tube is covered with a commercially available heat insulator KAOWOOL® and is positioned at an end of the furnace, within which a nitrogen atmosphere is generated. Subsequently, the sample tube is put into the sealed furnace. The pressure of the generated gas is detected by a pressure sensor, and its values are recorded and collected as a data by utilizing a signal converter and the like, until the values of the pressure become constant, that is, until the gas generation terminates. The amount of gas generation is calculated from the obtained data of the pressure, by using a pressure-volume conversion calibration curve (calibration curve on the basis of decomposition of potassium bicarbonate).

Amount of gas generation (ml/g)=Amount of gas generation in total (ml)/ Mass of the sample (g)

—Production Case of CS1 in the Wet State—

A spherical artificial molding sand LUNAMOS #60 (Trade Name; commercially available from Kao-Quaker Co., Ltd., JAPAN) was provided as a refractory aggregate, and sodium silicate No. 2 (molar ratio $SiO_2/Na_2O$: 2.5) was provided as a water glass which is a water-soluble inorganic binder. By addition of water, the water glass was controlled so as to have a solid content of 41% and a viscosity of 110 cP.

100 parts of the above-mentioned aggregate (LUNAMOS #60) was charged into a Shinagawa-type universal stirrer (5DM-r type; available from Dalton Corporation, JAPAN) at the room temperature. Furthermore, the above-mentioned water glass and spherical resin particles (average particle diameter: 2.0 μm) of polymethylsilsesquioxane as spherical particles of silicone resin having binder-repellency were fed into the stirrer, in an amount of 1.1 parts (solid content: 0.45 part) and in an amount of 0.05 part respectively, per 100 parts of the aggregate (LUNAMOS #60). The contents in the stirrer were kneaded for 2 minutes, and stirred and mixed to the extent that a uniform mixture was formed. Then, the formed mixture was taken out of the stirrer, whereby a mold material (coated sand): CS1 in the wet state consisting of the aggregate, the water glass and the spherical particles of silicone resin was obtained.

—Production Case of CS2 in the Wet State—

CS2 in the wet state was obtained by the same procedure as in the Production Case of CS1 in the wet state, except that the spherical particles of silicone resin were used in an amount of 0.10 part.

—Production Case of CS3 in the wet state—

CS3 in the wet state was obtained by the same procedure as in the Production Case of CS1 in the wet state, except that the spherical particles of silicone resin were used in an amount of 0.25 part.

—Production Case of CS4 in the Wet State—

CS4 in the wet state was obtained by the same procedure as in the Production Case of CS1 in the wet state, except that the spherical particles of silicone resin were used in an amount of 1.00 part.

—Production Case of CS5 in the Wet State—

CS5 in the wet state was obtained by the same procedure as in the Production Case of CS3 in the wet state, except that spherical resin particles of polymethylsilsesquioxane having an average particle diameter of 0.7 μm were used as the spherical particles of silicone resin having binder-repellency.

—Production Case of CS6 in the Wet State—

CS6 in the wet state was obtained by the same procedure as in the Production Case of CS3 in the wet state, except that spherical resin particles of polymethylsilsesquioxane having an average particle diameter of 5.0 μm were used as the spherical particles of silicone resin having binder-repellency.

—Production Case of CS7 in the Wet State—

CS7 in the wet state was obtained by the same procedure as in the Production Case of CS3 in the wet state, except that spherical resin particles of polymethylsilsesquioxane having an average particle diameter of 30 μm were used as the spherical particles of silicone resin having binder-repellency.

—Production Case of CS8 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 28% and a viscosity of 8 cP. Subsequently, CS8 in the wet state was obtained by the same procedure as in the Production Case of CS3 in the wet state, except that the water glass prepared above was added to the aggregate (LUNAMOS #60) in an amount of 1.61 parts (solid content: 0.45 part) per 100 parts of the aggregate.

—Production Case of CS9 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 37% and a viscosity of 29 cP. Subsequently, CS9 in the wet state was obtained by the same procedure as in the Production Case of CS3 in the wet state, except that the water glass prepared above was added to the aggregate (LUNAMOS #60) in an amount of 1.22 parts (solid content: 0.45 part) per 100 parts of the aggregate.

—Production Case of CS10 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 45% and a viscosity of 280 cP. Subsequently, CS10 in the wet state was obtained by the same procedure as in the Production Case of CS3 in the wet state, except that the water glass prepared above was added to the aggregate (LUNAMOS #60) in an amount of 1.00 parts (solid content: 0.45 part) per 100 parts of the aggregate.

—Production Case of CS11 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 46% and a viscosity of 630 cP. Subsequently, CS11 in the wet state was obtained by the same procedure as in the Production Case of CS3 in the wet state, except that the water glass prepared above was added to the aggregate (LUNAMOS #60) in an amount of 0.98 part (solid content: 0.45 part) per 100 parts of the aggregate.

—Production Case of CS12 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 47% and a viscosity of 940 cP. Subsequently, CS12 in the wet state was obtained by the same procedure as in the Production Case of CS3 in the wet state, except that the water glass prepared above was added to the aggregate (LUNAMOS #60) in an amount of 0.96 part (solid content: 0.45 part) per 100 parts of the aggregate.

—Production Case of CS13 in the Wet State—

CS13 in the wet state was obtained by the same procedure as in the Production Case of CS12 in the wet state, except that spherical resin particles of polymethylsilsesquioxane having an average particle diameter of 5.0 μm were used as the spherical particles of silicone resin having binder-repellency.

—Production Case of CS14 in the Wet State—

CS14 in the wet state was obtained by the same procedure as in the Production Case of CS1 in the wet state, except that potassium nitrate was provided as a nitrate and further used in an amount of 0.023 part per 100 parts of the aggregate, that is, in an amount of 5 parts per 100 parts of the solid content of the inorganic binder.

—Production Case of CS15 in the Wet State—

CS15 in the wet state was obtained by the same procedure as in the Production Case of CS3 in the wet state, except that potassium nitrate was provided as a nitrate and further used in an amount of 0.023 part per 100 parts of the aggregate, that is, in an amount of 5 parts per 100 parts of the solid content of the inorganic binder.

—Production Case of CS16 in the Wet State—

CS16 in the wet state was obtained by the same procedure as in the Production Case of CS3 in the wet state, except that sodium nitrate was provided as a nitrate and further used in an amount of 0.023 part per 100 parts of the aggregate, that is, in an amount of 5 parts per 100 parts of the solid content of the inorganic binder.

—Production Case of CS17 in the Wet State—

CS17 in the wet state was obtained by the same procedure as in the Production Case of CS3 in the wet state, except that calcium nitrate was provided as a nitrate and further used in an amount of 0.023 part per 100 parts of the aggregate, that is, in an amount of 5 parts per 100 parts of the solid content of the inorganic binder.

—Production Case of CS18 in the Wet State—

CS18 in the wet state was obtained by the same procedure as in the Production Case of CS1 in the wet state, except that the spherical particles of silicone resin were not used.

—Production Case of CS19 in the Wet State—

CS19 in the wet state was obtained by the same procedure as in the Production Case of CS3 in the wet state, except that spherical resin particles (average particle diameter: 5.0 μm) not having binder-repellency which were formed of cross-linked dimethylpolysiloxane were used as the spherical particles of silicone resin.

—Production Case of CS20 in the Wet State—

CS20 in the wet state was obtained by the same procedure as in the Production Case of CS3 in the wet state, except that resin particles (average particle diameter: 4.0 μm) of polymethylsilsesquioxane having irregular shapes were used in place of the spherical particles of silicone resin.

—Production Case of CS21 in the Wet State—

CS21 in the wet state was obtained by the same procedure as in the Production Case of CS3 in the Wet state, except that resin particles (average particle diameter: 7.0 μm) of polytetrafluoroethylene having irregular shapes were used in place of the spherical particles of silicone resin.

—Production Case of CS22 in the Wet State—

CS22 in the wet state was obtained by the same procedure as in the Production Case of CS3 in the wet state, except that spherical resin particles (average particle diameter: 6.0 μm) of polyethylene were used in place of the spherical particles of silicone resin.

—Production Case of CS23 in the Wet State—

CS23 in the wet state was obtained by the same procedure as in the Production Case of CS3 in the wet state, except that resin particles (average particle diameter: 2.0 μm) of polyethylene having irregular shapes were used in place of the spherical particles of silicone resin.

—Production Case of CS24 in the Wet State—

CS24 in the wet state was obtained by the same procedure as in the Production Case of CS3 in the wet state, except that particles (average particle diameter: 3.0 μm) of ethylene-bis-stearic acid amide having irregular shapes were used in place of the spherical particles of silicone resin.

—Production Case of CS25 in the Wet State—

CS25 in the wet state was obtained by the same procedure as in the Production Case of CS1 in the wet state, except that spherical particles of amorphous silica (average particle diameter: 3.0 μm) were used in place of the spherical particles of silicone resin, in an amount of 0.50 part per 100 parts of the aggregate (LUNAMOS #60).

—Production Case of CS26 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 48% and a viscosity of 1520 cP. Subsequently, CS26 in the wet state was obtained by the same procedure as in the Production Case of CS3 in the wet state, except that the water glass prepared above was added to the aggregate (LUNAMOS #60) in an amount of 0.94 part (solid content: 0.45 part) per 100 parts of the aggregate.

Formation Case I of Casting Molds (Examples 1-17 and Comparative Examples 1-9)

Each of the CS1-CS26 (temperature: 20° C.) produced according to the above-mentioned procedure was blown into a metal die heated to 150° C., at a gauge pressure of 0.3 MPa, and was thus filled in the metal die. The CS filled in the metal die was held within the metal die to be solidified or cured, whereby a sample (dimensions: 1.0 cm×1.0 cm×8.0 cm) for measuring a filling rate was obtained. The CSs which were used in the Examples 1-17 and the Comparative Examples 1-9 are shown in the following Tables 1-3.

The obtained sample for measuring a filling rate was measured of the filling rate according to the above-mentioned measuring method. Furthermore, a molding test and an aluminum casting test were conducted with respect to a casting mold manufactured from each of the CSs, and the casting mold was evaluated with respect to its mold-releasability, fluidity at filling and collapsibility, and the state of sand adhesion after casting process and surface roughness of a cast product obtained therefrom, according to the above-mentioned methods. The results are shown in the following Tables 1 to 3, along with the average particle diameter, the contact angle and the TG weight reduction ratio of the resin particles and the viscosity of the binder.

TABLE 1

| | | | Example 1 CS1 | Example 2 CS2 | Example 3 CS3 | Example 4 CS4 | Example 5 CS5 | Example 6 CS6 | Example 7 CS7 | Example 8 CS8 | Example 9 CS9 |
|---|---|---|---|---|---|---|---|---|---|---|---|
| Constitution of coated sand (CS) | Aggregate | Kind | LUNAMOS #60 | LUNAMOS #60 | LUNAMOS #60 | LUNAMOS #60 | LUNAMOS #60 | LUNAMOS #60 | LUNAMOS #60 | LUNAMOS #60 | LUNAMOS #60 |
| | | Amount (parts by mass) | 100 | 100 | 100 | 100 | 100 | 100 | 100 | 100 | 100 |
| | Water glass | Kind | No. 2 | No. 2 | No. 2 | No. 2 | No. 2 | No. 2 | No. 2 | No. 2 | No. 2 |
| | | Molar ratio | 2.5 | 2.5 | 2.5 | 2.5 | 2.5 | 2.5 | 2.5 | 2.5 | 2.5 |
| | | Solid content (% by mass) | 41 | 41 | 41 | 41 | 41 | 41 | 41 | 28 | 37 |
| | | Amount (parts by mass) | 1.10 | 1.10 | 1.10 | 1.10 | 1.10 | 1.10 | 1.10 | 1.61 | 1.22 |
| | | Viscosity (25° C., cP) | 110 | 110 | 110 | 110 | 110 | 110 | 110 | 8 | 25 |
| | Particles | Kind | Polymethyl silsesquioxane | Polymethyl silsesquioxane | Polymethyl silsesquioxane | Polymethyl silsesquioxane | Polymethyl silsesquioxane | Polymethyl silsesquioxane | Polymethyl silsesquioxane | Polymethyl silsesquioxane | Polymethyl silsesquioxane |
| | | Average particle diameter (μm) | 2.0 | 2.0 | 2.0 | 2.0 | 0.7 | 5.0 | 30 | 2.0 | 2.0 |
| | | Shape | Spherical | Spherical | Spherical | Spherical | Spherical | Spherical | Spherical | Spherical | Spherical |
| | | TG weight reduction ratio (%) | 12 | 12 | 12 | 12 | 14 | 14 | 58 | 12 | 12 |
| | | Amount (parts by mass) | 0.05 | 0.10 | 0.25 | 1.00 | 0.25 | 0.25 | 0.25 | 0.25 | 0.25 |
| | | Contact angle (°) | 135 | 135 | 135 | 135 | 129 | 129 | 126 | 135 | 135 |
| Sample (1 × 1 × 8 cm) | Filling rate (% by mass) | | 62.6 | 62.5 | 62.6 | 59.0 | 59.3 | 59.6 | 57.1 | 60.6 | 62.6 |
| Molding test | Mold releasability | | Good | Good | Good | Good | Good | Good | Good | Average | Good |
| | Fluidity at filling | Passage 1 | Good | Good | Good | Good | Average | Average | Average | Good | Good |
| | | Passage 2 | Good | Good | Good | Good | Good | Good | Good | Good | Good |
| | | Passage 3 | Good | Good | Good | Good | Good | Good | Good | Good | Good |
| | | Passage 4 | Good | Good | Good | Good | Good | Good | Good | Good | Good |
| Aluminum casting test | Collapsibility (number) | | 3 | 3 | 3 | 3 | 3 | 3 | 2 | 2 | 3 |
| | State of sand adhesion after casting process | | Good | Good | Good | Good | Good | Good | Good | Good | Good |
| | Surface roughness of cast product | | Good | Good | Good | Good | Good | Good | Average | Good | Good |

TABLE 2

| | | | Example 10 CS10 | Example 11 CS11 | Example 12 CS12 | Example 13 CS13 | Example 14 CS14 | Example 15 CS15 | Example 16 CS16 | Example 17 CS17 |
|---|---|---|---|---|---|---|---|---|---|---|
| Constitution of coated sand (CS) | Aggregate | Kind | LUNAMOS #60 | LUNAMOS #60 | LUNAMOS #60 | LUNAMOS #60 | LUNAMOS #60 | LUNAMOS #60 | LUNAMOS #60 | LUNAMOS #60 |
| | | Amount (parts by mass) | 100 | 100 | 100 | 100 | 100 | 100 | 100 | 100 |
| | Water glass | Kind | No. 2 | No. 2 | No. 2 | No. 2 | No. 2 | No. 2 | No. 2 | No. 2 |
| | | Molar ratio | 2.5 | 2.5 | 2.5 | 2.5 | 2.5 | 2.5 | 2.5 | 2.5 |
| | | Solid content (% by mass) | 45 | 46 | 47 | 47 | 41 | 41 | 41 | 41 |
| | | Amount (parts by mass) | 1.00 | 0.98 | 0.96 | 0.96 | 1.10 | 1.10 | 1.10 | 1.10 |
| | | Viscosity (25° C., cP) | 280 | 630 | 940 | 940 | 110 | 110 | 110 | 110 |
| | Particles | Kind | Polymethyl silsesquioxane | Polymethyl silsesquioxane | Polymethyl silsesquioxane | Polymethyl silsesquioxane | Polymethyl silsesquioxane | Polymethyl silsesquioxane | Polymethyl silsesquioxane | Polymethyl silsesquioxane |
| | | Average particle diameter (μm) | 2.0 | 2.0 | 2.0 | 2.0 | 2.0 | 2.0 | 2.0 | 2.0 |
| | | Shape | Spherical | Spherical | Spherical | Spherical | Spherical | Spherical | Spherical | Spherical |
| | | TG weight reduction ratio (%) | 12 | 12 | 12 | 12 | 12 | 12 | 12 | 12 |
| | | Amount (parts by mass) | 0.25 | 0.25 | 0.25 | 0.25 | 0.05 | 0.25 | 0.25 | 0.25 |
| | | Contact angle (°) | 135 | 135 | 136 | 136 | 135 | 135 | 135 | 135 |
| | Additive | Potassium nitrate (parts by mass) | — | — | — | — | 0.023 | 0.023 | — | — |
| | | Sodium nitrate (parts by mass) | — | — | — | — | — | — | 0.023 | — |
| | | Calcium nitrate (parts by mass) | — | — | — | — | — | — | — | 0.023 |
| Sample (1 × 1 × 8 cm) | Filling rate (% by mass) | | 61.3 | 59.2 | 58.4 | 56.6 | 62.4 | 62.6 | 62.2 | 62.0 |
| Molding test | Mold releasability | | Good | Good | Good | Good | Good | Good | Good | Good |
| | Fluidity at filling | Passage 1 | Good | Average | Average | Average | Good | Good | Good | Good |
| | | Passage 2 | Good | Good | Good | Good | Good | Good | Good | Good |
| | | Passage 3 | Good | Good | Good | Good | Good | Good | Good | Good |
| | | Passage 4 | Good | Good | Good | Good | Good | Good | Good | Good |
| Aluminum casting test | Collapsibility (number) | | 3 | 3 | 2 | 2 | 2 | 2 | 2 | 2 |
| | State of sand adhesion after casting process | | Good | Good | Good | Good | Good | Good | Good | Good |
| | Surface roughness of cast product | | Good | Good | Average | Average | Good | Good | Good | Good |

TABLE 3

| | | | Comparative Example 1 CS18 | Comparative Example 2 CS19 | Comparative Example 3 CS20 | Comparative Example 4 CS21 | Comparative Example 5 CS22 | Comparative Example 6 CS23 | Comparative Example 7 CS24 | Comparative Example 8 CS25 | Comparative Example 9 CS26 |
|---|---|---|---|---|---|---|---|---|---|---|---|
| Constitution of coated sand (CS) | Aggregate | Kind | LUNAMOS #60 | LUNAMOS #60 | LUNAMOS #60 | LUNAMOS #60 | LUNAMOS #60 | LUNAMOS #60 | LUNAMOS #60 | LUNAMOS #60 | LUNAMOS #60 |
| | | Amount (parts by mass) | 100 | 100 | 100 | 100 | 100 | 100 | 100 | 100 | 100 |
| | Water glass | Kind | No. 2 | No. 2 | No. 2 | No. 2 | No. 2 | No. 2 | No. 2 | No. 2 | No. 2 |
| | | Molar ratio | 2.5 | 2.5 | 2.5 | 2.5 | 2.5 | 2.5 | 2.5 | 2.5 | 2.5 |
| | | Solid content (% by mass) | 41 | 41 | 41 | 41 | 41 | 41 | 41 | 41 | 48 |
| | | Amount (parts by mass) | 1.10 | 1.10 | 1.10 | 1.10 | 1.10 | 1.10 | 1.10 | 1.10 | 0.94 |
| | | Viscosity (25° C., cP) | 110 | 110 | 110 | 110 | 110 | 110 | 110 | 110 | 1520 |
| | Particles | Kind | — | Cross-linked dimethyl polysiloxane | Polymethyl silsesquioxane | Polytetra fluoroethylene | Polyethylene | Polyethylene | Ethylene-bis-stearic acid amide | Amorphous silica | Polymethyl silsesquioxane |
| | | Average particle diameter (μm) | — | 5.0 | 4.0 | 7.0 | 6.0 | 2.0 | 3.0 | 3.0 | 2.0 |
| | | Shape | — | Spherical | irregular | irregular | Spherical | irregular | irregular | Spherical | Spherical |
| | | TG weight reduction ratio (%) | — | 68 | 12 | 100 | 100 | 100 | 100 | 0 | 12 |
| | | Amount (parts by mass) | — | 0.25 | 0.25 | 0.25 | 0.25 | 0.25 | 0.25 | 0.50 | 0.25 |
| | | Contact angle (°) | — | Not measurable | 133 | 142 | 136 | 134 | 133 | Not measurable | 137 |
| Sample (1 × 1 × 8 cm) | Filling rate (% by mass) | | 55.1 | 55.1 | 54.2 | 55.8 | 55.4 | 54.9 | 55.6 | 59.3 | 52.8 |
| Molding test | Mold releasability | | Average | Average | Good | Good | Good | Good | Good | Poor | Good |
| | Fluidity at filling | Passage 1 | Poor | Poor | Poor | Poor | Poor | Poor | Poor | Good | Poor |
| | | Passage 2 | Average | Average | Average | Average | Average | Average | Average | Good | Poor |
| | | Passage 3 | Good | Good | Good | Good | Good | Good | Good | Good | Average |
| | | Passage 4 | Good | Good | Good | Good | Good | Good | Good | Good | Good |
| Aluminum casting test | Collapsibility (number) | | 5 | 3 | 3 | 3 | 2 | 2 | 3 | 7 | 2 |
| | State of sand adhesion after casting process | | Poor | Average | Average | Average | Poor | Poor | Average | Good | Average |
| | Surface roughness of cast product | | Poor | Poor | Poor | Poor | Poor | Poor | Poor | Good | Poor |

As is apparent from the results shown in Tables 1 and 2, the mold materials :CS1-CS17 obtained in the Examples 1-17 according to the invention exhibited high filling rates. In the molding tests, the CSs exhibited excellent fluidity at filling and high mold-releasability. Besides, in the aluminum casting tests, the mold materials according to the invention proved to enjoy the excellent observation results with respect to the state of sand adhesion after a casting process. The mold materials according to the invention were excellent also in the evaluation results of the surface roughness of the obtained cast products.

On the other hand, as is apparent from the results shown in Table 3, the filling rate of the sample was low in the Comparative Example 1 using the CS18, in which the aggregate was mixed only with the water glass, without any particle being added to the aggregate. The CS18 was inferior with respect to the mold-releasability and the collapsibility in the molding test, and also with respect to the state of sand adhesion and the surface roughness of the obtained cast product in the aluminum casting test. In the Comparative Example 2, the CS19 containing the spherical particles of silicone resin not having binder-repellency was used together with the water glass, so that the filling rate was not sufficient, the mold-releasability and the collapsibility was inferior in the molding test, and the state of sand adhesion after casting process and the surface roughness were inferior in the aluminum casting test. Furthermore, the CS20-CS25 used in the Comparative Examples 3-8 contained the non-spherical resin particles, other resin particles, organic resin particles or spherical particles formed of a material different from silicone resin, so that the filling rate was inferior in these Comparative Examples, and the evaluation results in the molding tests and the aluminum casting tests were not good, either. In addition, the CS26 used in the Comparative Example 9 had a viscosity exceeding 1000 cP, so that the filling rate of the sample obtained from the CS26 was poor, the fluidity at filling was significantly deteriorated in the molding test, and the state of sand adhesion and the surface roughness of the cast product were inferior in the aluminum casting test.

Next, CS27-CS30 in the wet state were produced in the same procedure as described above, by using sodium chloride or sodium sulfate as the water-soluble inorganic binder in place of the water glass. The same evaluations as described above were conducted by using the CS27-CS30 in the wet state.

—Production Case of CS27 in the Wet State—

CS27 in the wet state was obtained by the same procedure as in the Production Case of CS3 in the wet state, except that an aqueous solution of sodium chloride (solid content: 20%) was used as the water-soluble inorganic binder in an amount of 3.3 parts (solid content: 0.66 part) per 100 parts of the aggregate.

—Production Case of CS28 in the Wet State—

CS28 in the wet state was obtained by the same procedure as in the Production Case of CS3 in the wet state, except that an aqueous solution of sodium sulfate (solid content: 20%) was used as the water-soluble inorganic binder in an amount of 3.3 parts (solid content: 0.66 part) per 100 parts of the aggregate.

—Production Case of CS29 in the Wet State—

CS29 in the wet state was obtained by the same procedure as in the Production Case of CS18 in the wet state, except that an aqueous solution of sodium chloride (solid content: 20%) was used as the water-soluble inorganic binder in an amount of 3.3 parts (solid content: 0.66 part) per 100 parts of the aggregate.

—Production Case of CS30 in the Wet State—

CS30 in the wet state was obtained by the same procedure as in the Production Case of CS18 in the wet state, except that an aqueous solution of sodium sulfate (solid content: 20%) was used as the water-soluble inorganic binder in an amount of 3.3 parts (solid content: 0.66 part) per 100 parts of the aggregate.

Formation Case II of Casting Molds (Examples 18-19 and Comparative Examples 10-11)

Each of the CS27-CS30 (temperature: 20° C.) produced according to the above-mentioned procedure was blown into a metal die heated to 150° C., at a gauge pressure of 0.3 MPa, and was thus filled in the metal die. The CS filled in the metal die was held within the metal die to be solidified or cured, whereby a sample (dimensions: 1.0 cm×1.0 cm×8.0 cm) for measuring a filling rate was obtained. The CSs which were used in the Examples 18-19 and the Comparative Examples 10-11 are shown in the following Table 4.

With respect to the obtained sample, the filling rate of the CS constituting the sample was measured. The CS was also subjected to a molding test to thereby measure its mold-releasability and fluidity at filling, according to the above-mentioned measuring methods. The results are shown in the following Table 4.

TABLE 4

| | | | Example 18 CS27 | Example 19 CS28 | Comparative Example 10 CS29 | Comparative Example 11 CS30 |
|---|---|---|---|---|---|---|
| Constitution of coated sand (CS) | Aggregate | Kind | LUNAMOS #60 | LUNAMOS #60 | LUNAMOS #60 | LUNAMOS #60 |
| | | Amount (parts by mass) | 100 | 100 | 100 | 100 |
| | Sodium chloride | Solid content (% by mass) | 20 | — | 20 | — |
| | | Amount (parts by mass) | 3.3 | — | 3.3 | — |
| | | Viscosity (25° C., cP) | 4 | — | 4 | — |
| | Sodium sulfate | Solid content (% by mass) | — | 20 | — | 20 |
| | | Amount (parts by mass) | — | 3.3 | — | 3.3 |
| | | Viscosity (25° C., cP) | — | 4 | — | 4 |
| | Particles | Kind | Polymethyl silsesquioxane | Polymethyl silsesquioxane | — | — |
| | | Average particle diameter (μm) | 2.0 | 2.0 | — | — |
| | | Shape | Spherical | Spherical | — | — |
| | | TG weight reduction ratio (%) | 12 | 12 | — | — |

TABLE 4-continued

| | | | Example 18 CS27 | Example 19 CS28 | Comparative Example 10 CS29 | Comparative Example 11 CS30 |
|---|---|---|---|---|---|---|
| | Amount (parts by mass) | | 0.25 | 0.25 | — | — |
| | Contact angle (°) | | 131 | 132 | — | — |
| Sample (1 × 1 × 8 cm) | Filling rate (% by mass) | | 62.3 | 61.9 | 54.9 | 54.5 |
| Molding test | Mold-releasability | | Good | Good | Poor | Poor |
| | Fluidity at filling | Passage 1 | Good | Good | Poor | Poor |
| | | Passage 2 | Good | Good | Average | Average |
| | | Passage 3 | Good | Good | Good | Good |
| | | Passage 4 | Good | Good | Good | Good |

As is apparent from the results shown in Table 4, in the Examples 18 and 19 in which sodium chloride and sodium sulfate were used as the water-soluble inorganic binder, the filling rate of the sample was high, and the mold-releasability and the fluidity at filling in the molding test were excellent. On the other hand, in the Comparative Examples 10-11 in which the CS29 and the CS30 not containing the spherical particles of silicone resin having binder-repellency according to the invention were used, the filling rate of the sample and the mold-releasability and the fluidity at filling in the molding test were inferior.

Furthermore, tests were conducted for examining the change of physical properties in the case where CSs were obtained by using water glasses having different viscosities as the water-soluble inorganic binder.

—Production Case of CS31 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 47% and a viscosity of 630 cP. Subsequently, CS31 in the wet state was obtained by the same procedure as in the Production Case of CS1 in the wet state, except that the water glass prepared above was added to the aggregate (LUNAMOS #60) in an amount of 0.98 part (solid content: 0.45 part) per 100 parts of the aggregate.

—Production Case of CS32 in the Wet State—

Sodium silicate No. 2 (molar ratio $SiO_2/Na_2O$: 2.5) was provided as a water glass which is a water-soluble inorganic binder. By addition of water, the water glass was controlled so as to have a solid content of 33% and a viscosity of 10 cP. Subsequently, CS32 in the wet state was obtained by the same procedure as in the Production Case of CS1 in the wet state, except that the water glass prepared above was added to the aggregate (LUNAMOS #60) in an amount of 1.36 parts (solid content: 0.45 part) per 100 parts of the aggregate.

—Production Case of CS33 in the Wet State—

CS33 in the wet state was obtained by the same procedure as in the Production Case of CS31 in the wet state, except that the spherical particles of silicone resin were not used.

—Production Case of CS34 in the Wet State—

CS34 in the wet state was obtained by the same procedure as in the Production Case of CS32 in the wet state, except that the spherical particles of silicone resin were not used.

—Production Case of CS35 in the Wet State—

CS35 in the wet state was obtained by the same procedure as in the Production Case of CS31 in the wet state, except that spherical resin particles (average particle diameter: 5.0 μm) not having binder-repellency which were formed of cross-linked dimethylpolysiloxane were used as the spherical particles of silicone resin in an amount of 0.25 part per 100 parts of the aggregate (LUNAMOS #60).

—Production Case of CS36 in the Wet State—

CS36 in the wet state was obtained by the same procedure as in the Production Case of CS32 in the wet state, except that spherical resin particles (average particle diameter: 5.0 μm) not having binder-repellency which were formed of cross-linked dimethylpolysiloxane were used as the spherical particles of silicone resin in an amount of 0.25 part per 100 parts of the aggregate (LUNAMOS #60).

—Production Case of CS37 in the Wet State—

CS37 in the wet state was obtained by the same procedure as in the Production Case of CS31 in the wet state, except that spherical particles of amorphous silica (average particle diameter: 3.0 μm) were used in place of the spherical particles of silicone resin, in an amount of 0.50 part per 100 parts of the aggregate (LUNAMOS #60).

—Production Case of CS38 in the Wet State—

CS38 in the wet state was obtained by the same procedure as in the Production Case of CS32 in the wet state, except that spherical particles of amorphous silica (average particle diameter: 3.0 μm) were used in place of the spherical particles of silicone resin, in an amount of 0.50 part per 100 parts of the aggregate (LUNAMOS #60).

Formation Case III of Casting Molds (Examples 1, 20 and 21, and Comparative Examples 1, 2, 8, 12-17)

Each of the CS1, CS18, CS19, CS25, CS31-CS38 (temperature: 20° C.) produced according to the above-mentioned procedure was blown into a metal die heated to 150° C., at a gauge pressure of 0.3 MPa, and was thus filled in the metal die. The CS filled in the metal die was held within the metal die to be solidified or cured, whereby a sample (dimensions: 1.0 cm×1.0 cm×8.0 cm) for measuring strength was obtained. The CSs which were used in the Examples 1, 20 and 21 and the Comparative Examples 1, 2, 8, 12-17 are shown in the following Tables 5 and 6.

The sample formed of each of the CSs used in those Examples and Comparative Examples was measured of its flexural strength according to the above-mentioned method. In addition, a molding test was conducted to evaluate its mold-releasability and fluidity at filling. The results are shown in the following Tables 5 and 6.

TABLE 5

| | | | Example 20 CS31 | Example 1 CS1 | Example 21 CS32 | Comparative Example 12 CS33 | Comparative Example 1 CS18 | Comparative Example 13 CS34 |
|---|---|---|---|---|---|---|---|---|
| Constitution of coated sand (CS) | Aggregate | Kind | LUNAMOS #60 | LUNAMOS #60 | LUNAMOS #60 | LUNAMOS #60 | LUNAMOS #60 | LUNAMOS #60 |
| | | Amount (parts by mass) | 100 | 100 | 100 | 100 | 100 | 100 |
| | Water glass | Kind | No. 2 | No. 2 | No. 2 | No. 2 | No. 2 | No. 2 |
| | | Molar ratio | 2.5 | 2.5 | 2.5 | 2.5 | 2.5 | 2.5 |
| | | Solid content (% by mass) | 47 | 41 | 33 | 47 | 41 | 33 |
| | | Amount (parts by mass) | 0.98 | 1.10 | 1.36 | 0.98 | 1.10 | 1.36 |
| | | Viscosity (25° C., cP) | 630 | 110 | 10 | 630 | 110 | 10 |
| | Particles | Kind | Polymethyl silsesquioxane | Polymethyl silsesquioxane | Polymethyl silsesquioxane | — | — | — |
| | | Average particle diameter (μm) | 2.0 | 2.0 | 2.0 | — | — | — |
| | | Shape | Spherical | Spherical | Spherical | — | — | — |
| | | TG weight reduction ratio (%) | 12 | 12 | 12 | — | — | — |
| | | Amount (parts by mass) | 0.05 | 0.05 | 0.05 | — | — | — |
| | | Contact angle (°) | 135 | 135 | 134 | — | — | — |
| Sample (1 × 1 × 8 cm) | Flexural Strength (N/cm$^2$) | | 640 | 741 | 760 | 363 | 478 | 539 |
| Molding test | Mold releasability | | Good | Good | Good | Average | Average | Poor |
| | Fluidity at filling | Passage 1 | Average | Good | Good | Poor | Poor | Poor |
| | | Passage 2 | Good | Good | Good | Poor | Average | Good |
| | | Passage 3 | Good | Good | Good | Good | Good | Good |
| | | Passage 4 | Good | Good | Good | Good | Good | Good |

TABLE 6

| | | | Comparative Example 14 CS35 | Comparative Example 2 CS19 | Comparative Example 15 CS36 | Comparative Example 16 CS37 | Comparative Example 8 CS25 | Comparative Example 17 CS38 |
|---|---|---|---|---|---|---|---|---|
| Constitution of coated sand (CS) | Aggregate | Kind | LUNAMOS #60 | LUNAMOS #60 | LUNAMOS #60 | LUNAMOS #60 | LUNAMOS #60 | LUNAMOS #60 |
| | | Amount (parts by mass) | 100 | 100 | 100 | 100 | 100 | 100 |
| | Water glass | Kind | No. 2 | No. 2 | No. 2 | No. 2 | No. 2 | No. 2 |
| | | Molar ratio | 2.5 | 2.5 | 2.5 | 2.5 | 2.5 | 2.5 |
| | | Solid content (% by mass) | 47 | 41 | 33 | 47 | 41 | 33 |
| | | Amount (parts by mass) | 0.98 | 1.10 | 1.36 | 0.98 | 1.10 | 1.36 |
| | | Viscosity (25° C., cP) | 630 | 110 | 10 | 630 | 110 | 10 |
| | Particles | Kind | Cross-linked dimethyl polysiloxane | Cross-linked dimethyl polysiloxane | Cross-linked dimethyl polysiloxane | Amorphous silica | Amorphous silica | Amorphous silica |
| | | Average particle diameter (μm) | 5.0 | 5.0 | 5.0 | 3.0 | 3.0 | 3.0 |
| | | Shape | Spherical | Spherical | Spherical | Spherical | Spherical | Spherical |
| | | TG weight reduction ratio (%) | 68 | 68 | 68 | 0 | 0 | 0 |
| | | Amount (parts by mass) | 0.25 | 0.25 | 0.25 | 0.50 | 0.50 | 0.50 |
| | | Contact angle (°) | Not measurable | Not measurable | Not measurable | Not measurable | Not measurable | Not measurable |
| Sample (1 × 1 × 8 cm) | Flexural Strength (N/cm$^2$) | | 477 | 587 | 620 | 443 | 558 | 572 |
| Molding test | Mold releasability | | Average | Average | Poor | Poor | Poor | Very Poor |
| | Fluidity at filling | Passage 1 | Poor | Poor | Poor | Average | Good | Good |
| | | Passage 2 | Poor | Average | Good | Good | Good | Good |
| | | Passage 3 | Good | Good | Good | Good | Good | Good |
| | | Passage 4 | Good | Good | Good | Good | Good | Good |

As is apparent from the results shown in Tables 5 and 6, each of the samples obtained in the Examples 1, 20-21 by using the CS according to the invention had excellent flexural strength, while each of the samples obtained in the Comparative Examples 1, 2, 8, 12-17 had low flexural strength, and exhibited poor mold-releasability and poor fluidity at filling in the molding test.

Furthermore, the amount of gas generation was measured with respect to each of the samples for measuring a filling rate produced in the Examples 3, 5 and 6 and the Comparative Examples 4-7, according to the above-mentioned measuring method. The results are shown in the following Table 7.

TABLE 7

| | | | Example 3 CS3 | Example 5 CS5 | Example 6 CS6 | Comparative Example 4 CS21 | Comparative Example 5 CS22 | Comparative Example 6 CS23 | Comparative Example 7 CS24 |
|---|---|---|---|---|---|---|---|---|---|
| Constitution of coated sand (CS) | Aggregate | Kind | LUNAMOS #60 | LUNAMOS #60 | LUNAMOS #60 | LUNAMOS #60 | LUNAMOS #60 | LUNAMOS #60 | LUNAMOS #60 |
| | | Amount (parts by mass) | 100 | 100 | 100 | 100 | 100 | 100 | 100 |
| | Water glass | Kind | No. 2 | No. 2 | No. 2 | No. 2 | No. 2 | No. 2 | No. 2 |
| | | Molar ratio | 2.5 | 2.5 | 2.5 | 2.5 | 2.5 | 2.5 | 2.5 |
| | | Solid content (% by mass) | 41 | 41 | 41 | 41 | 41 | 41 | 41 |
| | | Amount (parts by mass) | 1.10 | 1.10 | 1.10 | 1.10 | 1.10 | 1.10 | 1.10 |
| | | Viscosity (25° C., cP) | 110 | 110 | 110 | 110 | 110 | 110 | 110 |
| | Particles | Kind | Polymethyl silsesquioxane | Polymethyl silsesquioxane | Polymethyl silsesquioxane | Polytetra fluoroethylene | Polyethylene | Polyethylene | Ethylene-bis stearic acid amide |
| | | Average particle diameter (μm) | 2.0 | 0.7 | 5.0 | 7.0 | 6.0 | 2.0 | 3.0 |
| | | Shape | Spherical | Spherical | Spherical | Irregular | Spherical | Irregular | Irregular |
| | | TG weight reduction ratio (%) | 12 | 14 | 14 | 100 | 100 | 100 | 100 |
| | | Amount (parts by mass) | 0.25 | 0.25 | 0.25 | 0.25 | 0.25 | 0.25 | 0.25 |
| | | Contact angle (°) | 135 | 129 | 129 | 142 | 136 | 134 | 133 |
| Amount of gas generation (700° C., ml/g) | | | 2.3 | 2.3 | 2.3 | 2.8 | 4.2 | 4.2 | 4.3 |

As is apparent from the results shown in Table 7, each of the samples of the Examples 3, 5 and 6, in which the CSs containing the spherical particles of silicone resin having binder-repellency according to the invention were used, generated a small amount of gas. In contrast, each of the samples of the Comparative Examples 4-7, in which the CSs containing resin particles of a material outside the scope of the invention or organic particles were used, generated a large amount of gas. Consequently, it is recognized that these Comparative Examples have an inherent problem that gas deficiency may be caused in a cast product to be obtained.

Furthermore, tests were conducted for examining the change of physical properties in the case where CSs were obtained by using flattery silica sand as the refractory aggregate in place of the artificial sand.

—Production Case of CS39 in the Wet State—

CS39 in the wet state was obtained by the same procedure as in the Production Case of CS1 in the wet state, except that flattery silica sand consisting of irregular particles was used as the refractory aggregate in place of the LUNAMOS #60, the water glass was used in an amount of 2.06 parts (solid content: 0.85 part) per 100 parts of the aggregate (flattery silica sand), and further the spherical particles of silicone resin were used in an amount of 0.25 part.

—Production Case of CS40 in the Wet State—

CS40 in the wet state was obtained by the same procedure as in the Production Case of CS39 in the wet state, except that the spherical particles of silicone resin were used in an amount of 0.5 part.

—Production Case of CS41 in the Wet State—

CS41 in the wet state was obtained by the same procedure as in the Production Case of CS39 in the wet state, except that sodium silicate No. 1 (molar ratio $SiO_2/Na_2O$: 2.1; solid content: 40%) was used as the water glass, in an amount of 2.13 parts (solid content: 0.85 part) per 100 parts of the flattery silica sand.

—Production Case of CS42 in the Wet State—

CS42 in the wet state was obtained by the same procedure as in the Production Case of CS39 in the wet state, except that sodium silicate No. 3 (molar ratio $SiO_2/Na_2O$: 3.2; solid content: 38%) was used as the water glass, in an amount of 2.24 parts (solid content: 0.85 part) per 100 parts of the flattery silica sand.

—Production Case of CS43 in the Wet State—

CS43 in the wet state was obtained by the same procedure as in the Production Case of CS39 in the wet state, except that the spherical particles of silicone resin were not used.

Formation Case IV of Casting Molds (Examples 22-25 and Comparative Example 18)

Each of the CS39-CS43 (temperature: 20° C.) produced according to the above-mentioned procedure was blown into a metal die heated to 150° C., at a gauge pressure of 0.3 MPa, and was thus filled in the metal die. The CS filled in the metal die was held within the metal die to be solidified or cured, whereby a sample (dimensions: 1.0 cm×1.0 cm×8.0 cm) for measuring a filling rate was formed. The CSs which were used in the Examples 22-25 and the Comparative Example 18 are shown in the following Table 8

With respect to the formed sample, the filling rate, mold-releasability, fluidity at filling, collapsibility, state of sand adhesion after casting process and surface roughness of the obtained cast product were evaluated according to the above-mentioned methods. The results are shown in the following Table 8.

TABLE 8

| | | | Example 22 CS39 | Example 23 CS40 | Example 24 CS41 | Example 25 CS42 | Comparative Example 18 CS43 |
|---|---|---|---|---|---|---|---|
| Constitution of coated sand (CS) | Aggregate | Kind | Flattery silica sand | Flattery silica sand | Flattery silica sand | Flattery silica sand | Flattery silica sand |
| | | Amount (parts by mass) | 100 | 100 | 100 | 100 | 100 |
| | Water glass | Kind | No. 2 | No. 2 | No. 1 | No. 3 | No. 2 |
| | | Molar ratio | 2.5 | 2.5 | 2.1 | 3.2 | 2.5 |
| | | Solid content (% by mass) | 41 | 41 | 40 | 38 | 41 |
| | | Amount (parts by mass) | 2.06 | 2.06 | 2.13 | 2.24 | 2.06 |
| | | Viscosity (25° C., cP) | 110 | 110 | 98 | 116 | 110 |
| | Particles | Kind | Polymethyl silsesquioxane | Polymethyl silsesquioxane | Polymethyl silsesquioxane | Polymethyl silsesquioxane | — |
| | | Average particle diameter (μm) | 2.0 | 2.0 | 2.0 | 2.0 | — |
| | | Shape | Spherical | Spherical | Spherical | Spherical | — |
| | | TG weight reduction ratio (%) | 12 | 12 | 12 | 12 | — |
| | | Amount (parts by mass) | 0.25 | 0.50 | 0.25 | 0.25 | — |
| | | Contact angle (°) | 135 | 135 | 135 | 135 | — |
| Sample (1 × 1 × 8 cm) | Filling rate (% by mass) | | 59.8 | 60.8 | 59.6 | 58.7 | 54.4 |
| Molding test | Mold-releasability | | Good | Good | Good | Good | Average |
| | Fluidity at filling | Passage 1 | Average | Average | Average | Average | Poor |
| | | Passage 2 | Average | Average | Average | Average | Poor |
| | | Passage 3 | Good | Good | Good | Average | Average |
| | | Passage 4 | Good | Good | Good | Good | Good |
| Aluminum casting test | Collapsibility (number) | | 4 | 4 | 4 | 4 | 7 |
| | State of sand adhesion after casting process | | Average | Good | Average | Average | Poor |
| | Surface roughness of cast product | | Average | Average | Average | Average | Poor |

As is apparent from the results shown in Table 8, the effects of the invention were achieved also in the case where the flattery silica sand was used in place of the artificial aggregate as the refractory aggregate. Meanwhile, in the Examples 22, 24 and 25, the water glass Nos. 1 to 3 were used. The flexural strength was 416.0N/cm$^2$ in the Example 22, 425.7N/cm$^2$ in the Example 24 and 342.4N/cm$^2$ in the Example 25. Thus, it is recognized that the water glass Nos. 1 and 2 are more desirable in terms of the strength of the casting mold.

NOMENCLATURE OF REFERENCE SIGNS

| | |
|---|---|
| 1-4 Passages | 5 Mold half |
| 6 Filling inlet | |
| 12 Molten metal inlet | 14 Baseboard fixing portion |
| 16 Main mold | 18 Baseboard |
| 20 Core | 22 Sand mold |
| 24 Waste core sand discharge port | |
| 26 Cast product | |

The invention claimed is:

1. A mold material, comprising:

a refractory aggregate, a water-soluble inorganic binder in a liquid state having a viscosity of not more than 1000 cP, and spherical particles of a silicone resin having binder-repellency mixed with each other, such that the spherical particles of the silicone resin exist on a surface of a coating layer formed of the water-soluble inorganic binder around the refractory aggregate, to provide the mold material as a coated sand in a wet state having the spherical particles of the silicone resin on the surface of the coating layer.

2. The mold material according to claim 1, wherein the spherical particles of the silicone resin have a weight reduction ratio in a range of 5-50% when the spherical particles of the silicone resin are heated in a thermogravimetric/differential thermal analyzer from room temperature to 700° C. in an air atmosphere.

3. The mold material according to claim 1, wherein an average particle diameter of the spherical particles of the silicone resin is in a range of 0.01 μm-50 μm.

4. The mold material according to claim 1, wherein a content of the spherical particles of the silicone resin is in a range of 0.1-500 parts by mass per 100 parts by mass of a solid content of the water-soluble inorganic binder in the mold material.

5. The mold material according to claim 1, wherein the spherical particles of silicone resin have a main component of organopolysiloxane.

6. The mold material according to claim 5, wherein the organopolysiloxane is silsesquioxane.

7. The mold material according to claim 6, wherein the silsesquioxane is polymethylsilsesquioxane.

8. The mold material according to claim 1, wherein the binder-repellency of the spherical particles of the silicon resin is characterized in that, when the water-soluble inorganic binder in the liquid state is dripped on a horizontal plane formed of the spherical particles of the silicone resin, a contact angle between the water-soluble inorganic binder and the horizontal plane is not less than 90°.

9. The mold material according to claim 1, further comprising at least one nitrate selected from the group consisting of alkali metal salts and alkaline earth metal salts of nitric acid.

10. The mold material according to claim 1, wherein the water-soluble inorganic binder contains a water glass as a main component thereof.

11. A method of manufacturing a casting mold, the method comprising:

providing the mold material according to claim 1;

filling the mold material in a heated forming mold; and holding the mold material within the forming mold to solidify or cure the molding material to thereby obtain the casting mold.

12. A method of producing a mold material, the method comprising:

providing a water-soluble inorganic binder in a liquid state having a viscosity of not more than 1000 cP;

providing spherical particles of a silicone resin having binder-repellency;

providing a refractory aggregate;

adding the water-soluble inorganic binder and the spherical particles of the silicone resin to the refractory aggregate; and kneading or mixing the water-soluble inorganic binder and the spherical particles of the silicone resin with the refractory aggregate at room temperature, such that the spherical particles of the silicone resin exist on a surface of a coating layer formed of the water-soluble inorganic binder around the refractory aggregate, to provide a coated sand in a wet state having the spherical particles of the silicone resin on the surface of the coating layer.

13. A method of producing a mold material, the method comprising:

providing a water-soluble inorganic binder in a liquid state having a viscosity of not more than 1000 cP;

providing spherical particles of a silicone resin having binder-repellency;

providing a refractory aggregate;

separately adding the water-soluble inorganic binder and a predetermined amount of water to the refractory aggregate;

adding the spherical particles of the silicone resin to the refractory aggregate; and kneading or mixing the water-soluble inorganic binder and the spherical particles of the silicone resin with the refractory aggregate at room temperature, such that the spherical particles of the silicone resin exist on a surface of a coating layer formed of the water-soluble inorganic binder around the refractory aggregate, to provide a coated sand in a wet state having the spherical particles of the silicone resin on the surface of the coating layer.

* * * * *